US006494194B2

(12) United States Patent
Shipachev et al.

(10) Patent No.: US 6,494,194 B2
(45) Date of Patent: Dec. 17, 2002

(54) MULTI-CHARGE GAS-CYLINDER PISTOL

(75) Inventors: Aleksei Borisovich Shipachev, Kazan (RU); Aleksei Lvovich Petrosyan, Moscow (RU)

(73) Assignee: Zakrytoe aktsionernoe obschhestvo "Group Anics", Moscow (RU)

( * ) Notice: Subject to any disclaimer, the term of this patent is extended or adjusted under 35 U.S.C. 154(b) by 0 days.

(21) Appl. No.: 09/926,422

(22) PCT Filed: Feb. 23, 2001

(86) PCT No.: PCT/RU01/00078

§ 371 (c)(1),
(2), (4) Date: Oct. 30, 2001

(87) PCT Pub. No.: WO01/67023

PCT Pub. Date: Sep. 13, 2001

(65) Prior Publication Data

US 2002/0139362 A1 Oct. 3, 2002

(30) Foreign Application Priority Data

Mar. 9, 2000 (RU) ..... 00105515

(51) Int. Cl.[7] ..... F41B 11/00

(52) U.S. Cl. ..... 124/73; 124/76; 124/31; 124/52

(58) Field of Search ..... 89/33.1, 33.14, 89/33.16, 33.17; 42/11, 17, 18, 21, 22, 29, 49.01, 50; 124/73, 74

(56) References Cited

U.S. PATENT DOCUMENTS

| | | | | |
|---|---|---|---|---|
| 2,086,339 | A | * | 7/1937 | Sosso |
| 2,881,752 | A | * | 4/1959 | Blahnik |
| 3,048,159 | A | * | 8/1962 | Kline et al. |
| 3,077,875 | A | | 2/1963 | Kline et al. |
| 3,207,143 | A | | 9/1965 | Kline et al. |
| 3,447,527 | A | | 6/1969 | Cermak et al. |
| 3,527,194 | A | | 9/1970 | Vadas |
| 4,147,152 | A | | 4/1979 | Fischer et al. |

(List continued on next page.)

FOREIGN PATENT DOCUMENTS

| | | | |
|---|---|---|---|
| EP | 0 625 689 | | 11/1994 |
| EP | 0 922 922 | | 6/1999 |
| GB | 1101405 | | 1/1968 |
| RU | 2084802 | * | 7/1997 |
| RU | 2118781 | * | 9/1998 |

OTHER PUBLICATIONS

PCT Publication WO 97/00417, Mar. 1996, Petrosyan.*

*Primary Examiner*—Michael J. Carone
*Assistant Examiner*—Troy Chambers
(74) *Attorney, Agent, or Firm*—Jacobson Holman PLLC

(57) ABSTRACT

The present invention relates to compressed gas-operated firearms and more particularly to repeating gas cylinder pistols with conveyer feed of bullets for shooting. The pistol comprises a hollow pistol frame (1) made integral with a grip (3) and a trigger bow (50), a movable barrel (6) with a bullet bore (97), a load (12) and a mainspring (19) disposed on the barrel (6), a valve (57) installed in a gas chamber (110) inside a body (56), a gas cylinder (102) installed inside a rear hollow interior (104) of the grip (3), a magazine (27) installed in a front hollow interior (151) of the grip (3), separated from a rear hollow interior (104) by a partition (150), a striker-and-trigger mechanism installed inside the pistol frame (1) and on the trigger bow (50) and interacting with the movable barrel (6) and the magazine (27) for supplying bullets (246) and portions of gas from the gas cylinder (102) to the bullet bore (97) of the barrel (6), a mechanism for installing the gas cylinder (102), disposed below the gas cylinder (102) in the grip (3). In a hollow interior (4) of the pistol grip (1) a support (5) is installed, which serves as a base for the movable barrel (6) that moves along the support (5) under the action of the striker-and-trigger mechanism.

80 Claims, 13 Drawing Sheets

U.S. PATENT DOCUMENTS 5,404,863 A * 4/1995 Poor ..... 124/56
5,476,087 A * 12/1995 Kunimoto ..... 124/73
5,477,843 A * 12/1995 Kunimoto ..... 124/73
5,509,399 A * 4/1996 Poor ..... 124/74
5,655,510 A * 8/1997 Kunimoto ..... 124/73
5,664,552 A * 9/1997 Kunimoto ..... 124/73
5,711,286 A * 1/1998 Petrosyan et al. ..... 124/53
5,884,615 A * 3/1999 Casas Salva ..... 124/31
5,906,191 A * 5/1999 Wonisch et al. ..... 124/31
6,026,797 A 2/2000 Maeda et al.
6,029,645 A * 2/2000 Wonisch et al. ..... 124/74
6,073,620 A * 6/2000 Kunimoto ..... 124/74
6,112,734 A * 9/2000 Kunimoto ..... 124/56
6,158,424 A * 12/2000 Kunimoto ..... 124/73
6,415,702 B1 * 7/2002 Szabo et al. ..... 42/70.08

* cited by examiner

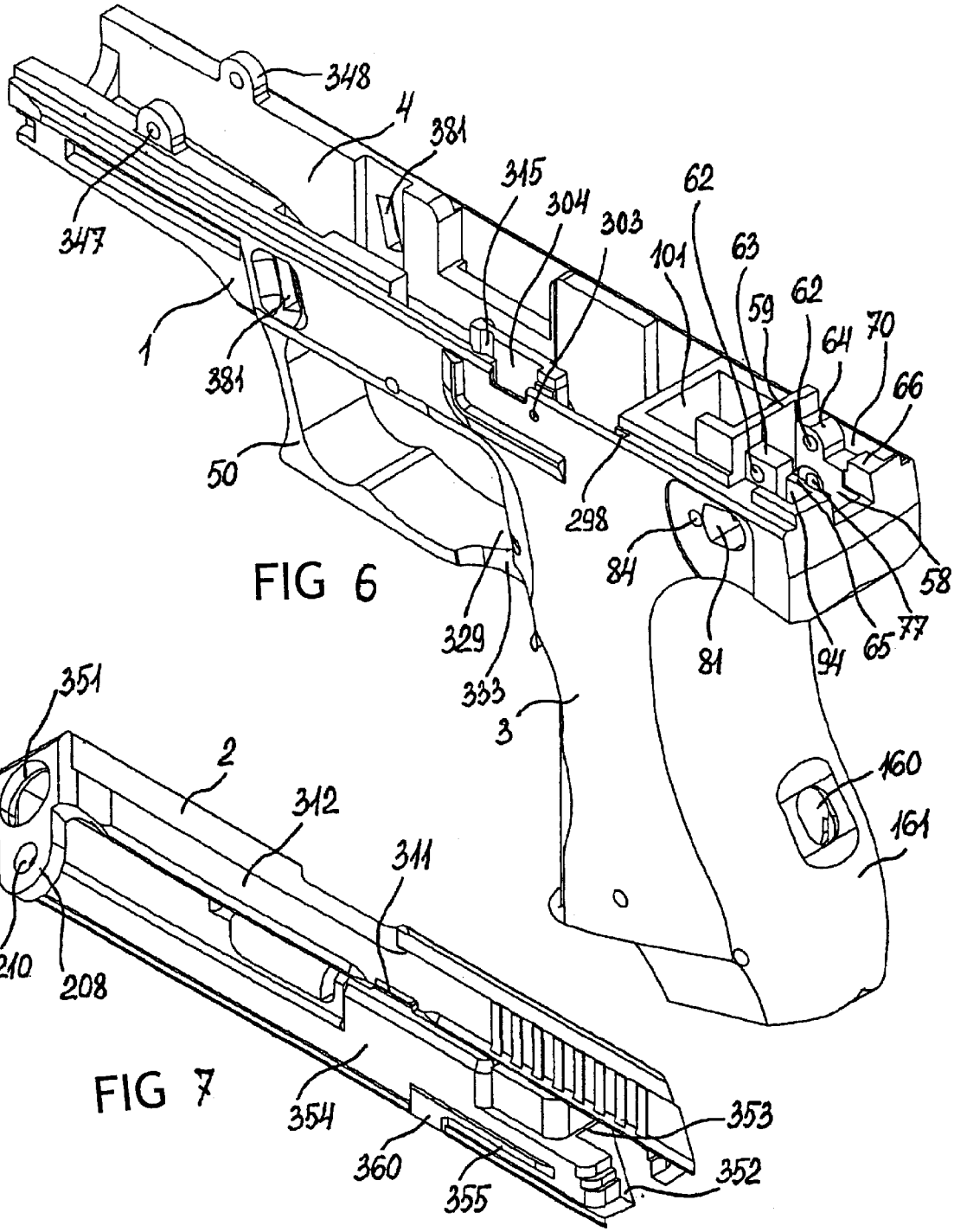
FIG 6
FIG 7
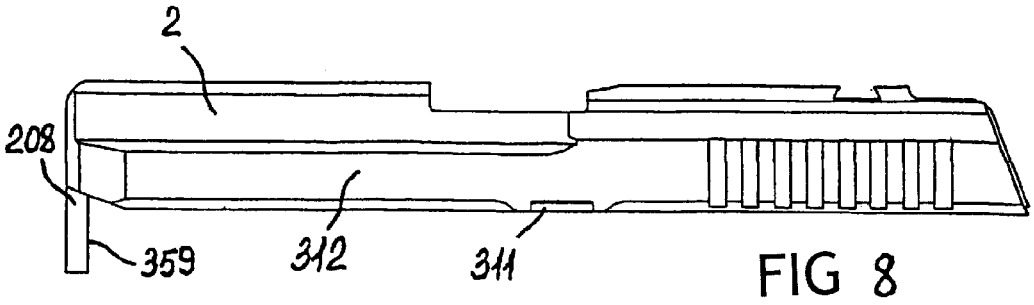
FIG 8

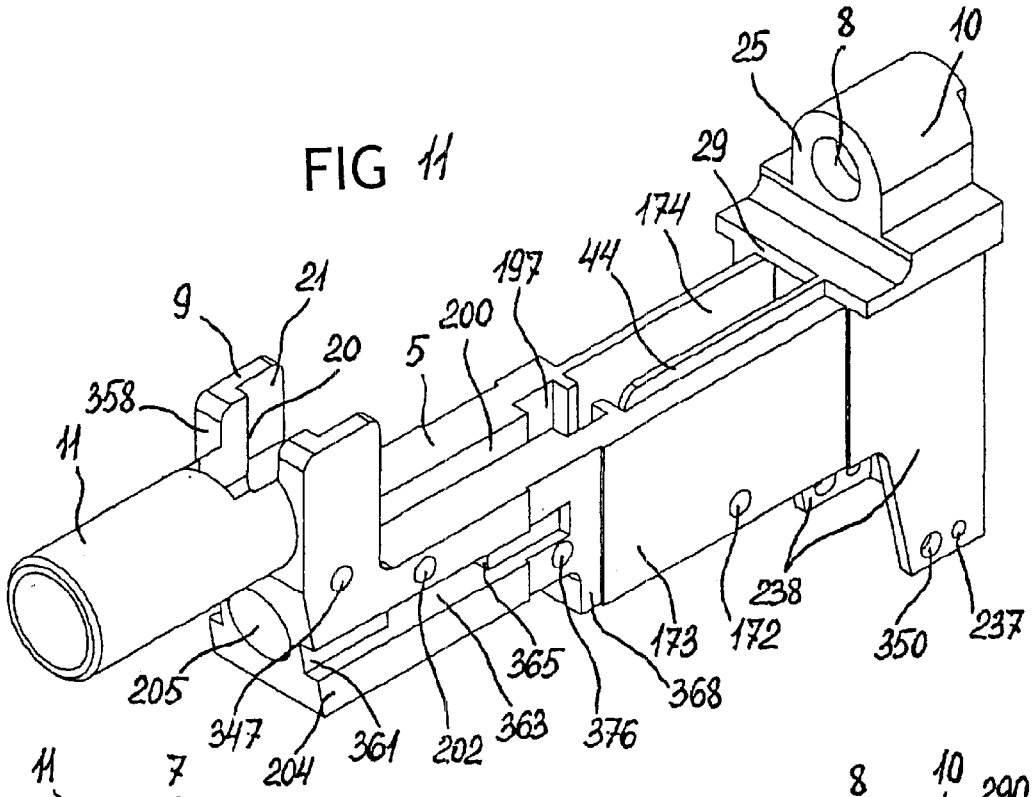
FIG 11
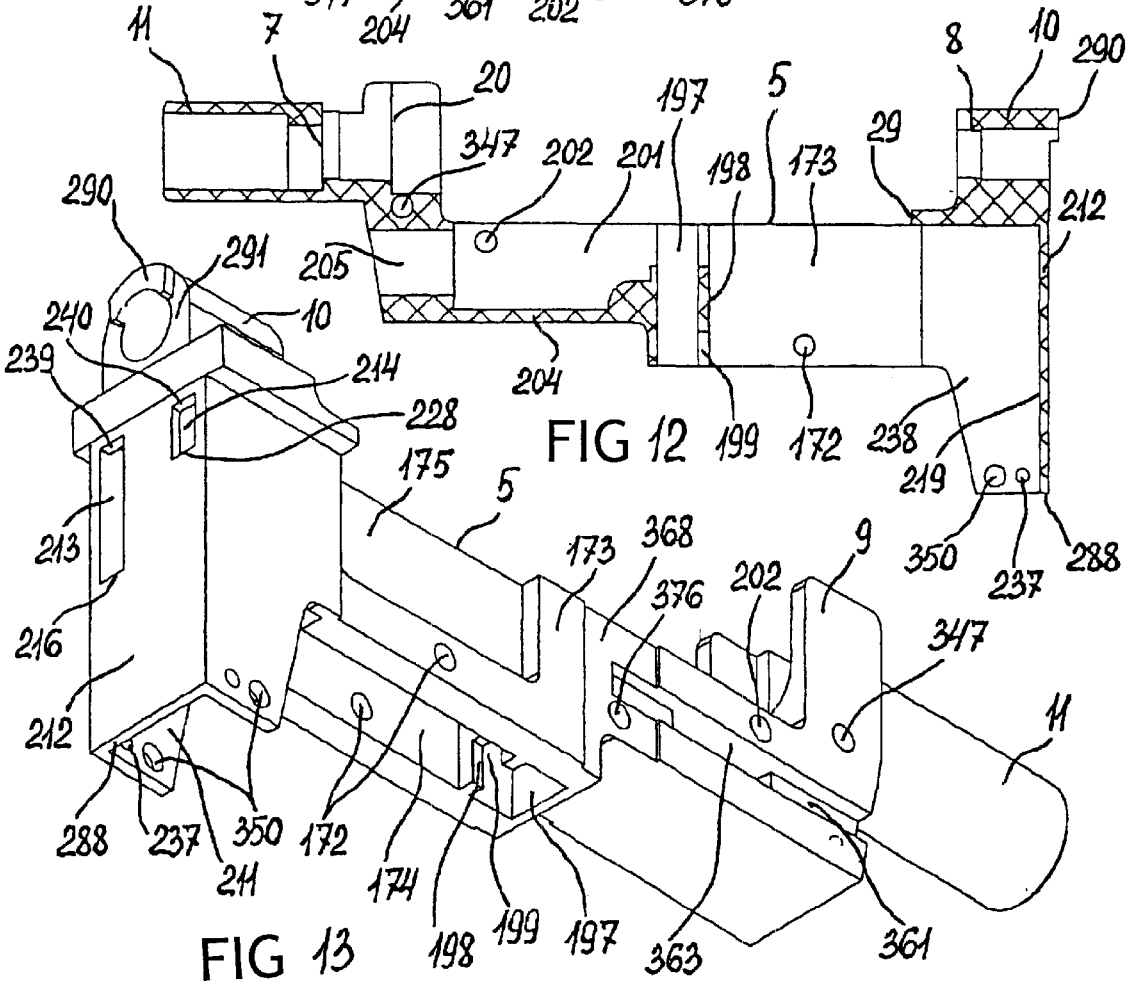
FIG 12
FIG 13

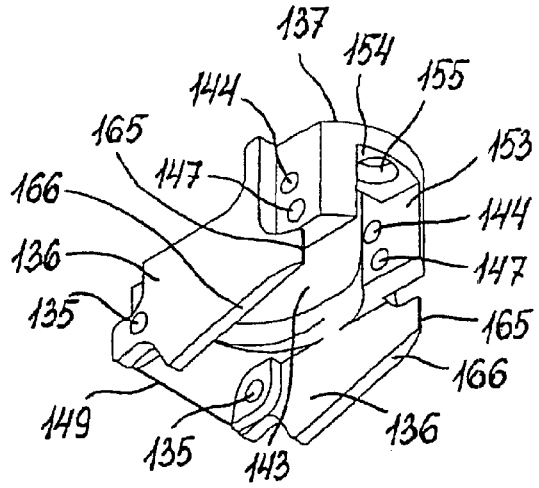
FIG 44
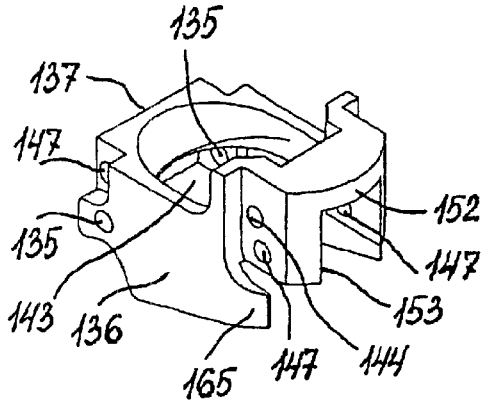
FIG 43
FIG 45
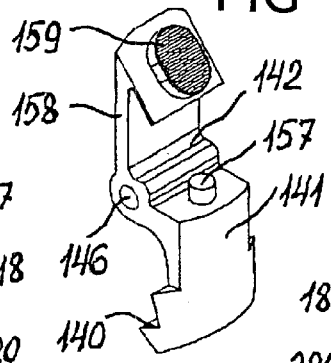
FIG 46
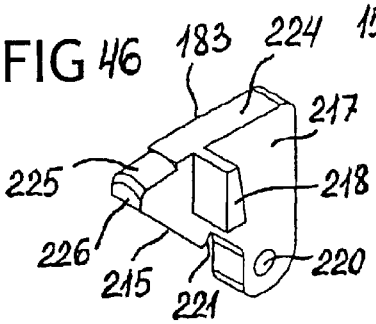
Фиг. 47
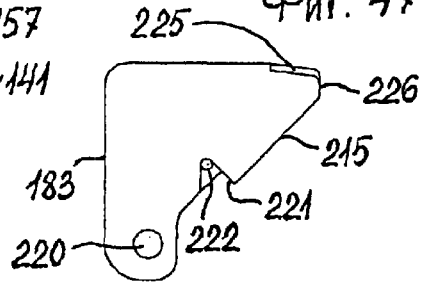
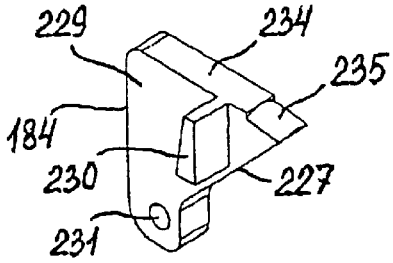
FIG 48
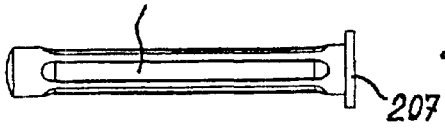
FIG 50
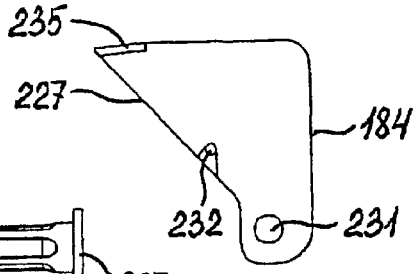
FIG 49
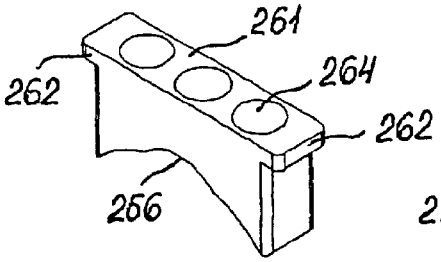
FIG 51
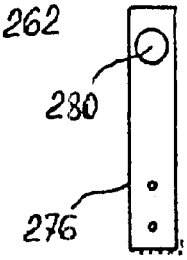
FIG 53
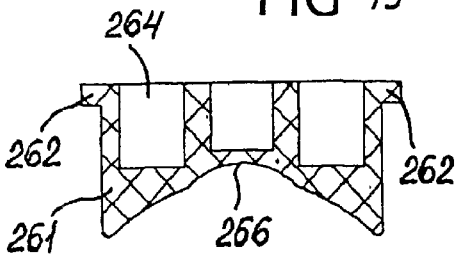
FIG 52

MULTI-CHARGE GAS-CYLINDER PISTOL

This is a nationalization of PCT/RU01/00078 filed Feb. 23, 2001 and published in Russian.

FIELD OF THE ART

The present invention relates to compressed gas-operated firearms and more particularly to repeating gas cylinder pistols with conveyer feed of bullets for shooting.

STATE OF THE ART

Known in the art are technical solutions of a repeating gas cylinder pistol shooting ball bullets: U.S. Pat. No. 3,077,875, Cl. 124-11, 1963; U.S. Pat. No. 3,207,143, Cl. 124-11, 1965; U.S. Pat. No. 3,447,527, Cl. 124-52, 1969; U.S. Pat. No. 3,527,194, Cl. 124-11, 1970; U.S. Pat. No. 4,147,152, Cl. 124-76, 1979; Patent EP 0,625,689, 1994; Patent RU 2,084,802, Cl. 6F41B Nov. 6, 1997. However, the reliability and shooting rate of these constructions are low.

The prior art most relevant to the present invention is a repeating gas cylinder pistol shooting ball bullets (Patent RU No. 2,118,781, Cl. F41B Nov. 6, 1998), comprising a pistol frame with a grip, a movable barrel with an opening for introducing bullets and with a load and a mainspring located thereon between the load and a slider base disposed in the frame at the end of the frame, a magazine, an insert disposed within the grip and the other end of the frame, with a gas supply passage inside the insert, a gas cylinder disposed with the help of a sleeve, a cover, a loop in a nut in the grip and communicated via a seal through a piercing needle of the gas cylinder with a passage for supplying a portion of gas to a chamber of a valve for supplying a portion of gas, a valve for supplying a portion of gas, disposed inside a body of the valve for supplying a portion of gas, and a body of the valve for supplying a portion of gas disposed inside the insert, a frame attached to the pistol frame and to the grip, a trigger secured by a rotation axle on the frame, a sear arm connected to a return spring secured on the frame, a lock, wherein the magazine with a lifting spring is disposed with the help of a shoe, a compression spring, a latch and a hold-down spring in the grip between the gas cylinder separated by the inner wall of the grip from the magazine, the insert and the frame under the movable barrel, and is tightly pressed to the body of the valve for supplying a portion of gas, the movable barrel is set on the valve for supplying a portion of gas, which has openings for supplying a portion of gas to the movable barrel from the chamber of the valve for supplying a portion of gas, which chamber through openings in the body of the valve for supplying a portion of gas is communicated to the gas supply passage, the spring of the valve for supplying a portion of gas is disposed between the insert and the sleeve of the valve for supplying a portion of gas, disposed on the valve for supplying a portion of gas, the seal of the valve for supplying a portion of gas is disposed between the sleeve of the valve for supplying a portion of gas and the openings for supplying gas to the movable barrel, the sear arm is disposed on an axle of an arm of the trigger, an attachment is disposed on the lower part of the load, the safety lock is disposed in a through opening made in the pistol frame perpendicular to the axis of the movable barrel under the attachment, a blocking element is disposed in a recess made in the frame under the safety lock, a magnet is disposed in the chamber of the valve for supplying a portion of gas on the sleeve of the valve for supplying a portion of gas, an anti-retainer disposed in the form of a projection on the frame inside the pistol frame.

In spite of a number of advantages, such as the possibility of shooting with the movable barrel of the pistol in any position, even in the direction of action of the Earth's attraction force, and an increased shooting rate by combining the operations of winding the mainspring and introducing the ball bullet into the barrel only on pulling the trigger of the pistol, the above-described construction has a number of disadvantages: limitations to the shape and material of bullets, since the in the above-described construction it is possible to use only ball steel or steel-core bullets; shortened service life of the striker mechanism because of constant mechanical effect of the barrel on the valve at the moment of shooting; a small capacity of the magazine; a low reliability, because the process of feeding bullets to the shooting position is not controllable, the probability of a misfire being thus increased, and because a shot may be taken even in the absence of the magazine in the pistol grip.

ESSENCE OF THE INVENTION

The present invention is directed to the provision of a repeating gas cylinder pistol with such structural elements and connections therebetween, that would make it possible to increase substantially the reliability, to improve and broaden the functional potentialities, and to raise the performance characteristics of the pistol.

Said object is accomplished by the provision of a repeating compressed-gas operated pistol, comprising a hollow frame made integral with a grip and a trigger bow, a movable barrel with a bullet bore, a load and a mainspring disposed on the barrel, a valve installed in a gas chamber inside the pistol frame, between the rear inner wall of which and the valve a spring is installed, which insures returning of the valve to the closed state after a portion of gas has come from the gas chamber to the bullet bore of the barrel, a valve body whose lower part is disposed in a depression in the rear part of the pistol frame above a gas cylinder which is installed in a rear hollow interior of the grip and via a sleeve, a nut and an end seal is communicated with the valve body, and via a piercing needle, a filter and a passage in the frame insures coming of a portion of gas to the gas chamber, a magazine, installed in a front hollow interior separated from a rear hollow interior of the grip by a partition, a striker-and-trigger mechanism installed inside the pistol frame and on the trigger bow and interacting with the movable barrel and the magazine for supplying bullets and portions of gas from the gas cylinder to the bullet bore of the barrel, a mechanism for installing a gas cylinder disposed below the gas cylinder in a lower broadened part of the rear hollow interior of the grip, in the rear hollow interior of the pistol frame a support is located, whose rear wall contacts the front wall of the magazine, a part of the support extending above the pistol frame serving to bear the barrel movable along the support under the action of the striker-and-trigger mechanism, the magazine insures conveyer supply of bullets to the shooting line and is equipped with containers, each container accommodating one bullet and being installed so that the upper part of the magazine, extending above the pistol frame, is disposed between the barrel and the valve, and a bullet opening provided in the front wall of the magazine, through which the bullet enters the bullet bore of the barrel under the effect of a portion of gas, is disposed coaxially with the bullet bore, the valve and the container which occupies such position before each shot, a breech mechanism is installed on top of the hollow pistol frame.

The mechanism for installing a gas cylinder comprises a bracket installed with the help of pins in the lower broadened part of the rear hollow interior of the grip, a front wall being disposed under a partition and adjoining the magazine, the surface of the wall lying in one plane with the surface of the partition adjoining the magazine; a lever installed in the rear part of the bracket on an axle of rotation, a frame and a loop mounted on a turning axle in a front part of the bracket more proximate to the magazine, a hold-down member mounted on an axle of rotation on the frame on the side opposite the place of fastening the frame to the bracket, a tightening screw located in the central part of the loop. The tightening screw has a link with which the screw abuts against the bottom part of the gas cylinder when the frame is in the closed position, and which, as the screw is screwed into the loop through an opening, urges the gas cylinder till it is pressed to the piercing needle of the gas cylinder. The bracket has in the central part an opening through which the gas cylinder is installed in the rear hollow interior of the grip, when the frame is in the open position, a groove disposed in a rear wall and combined with the opening, in which groove the lever is disposed, there being provided a horizontal wall above the part of the groove which is nearer to a rear wall of the grip, in which horizontal wall from the side of the groove there is a depression, and side walls which have horizontal platforms disposed from below and lugs disposed from the side of the groove and abutting against supports provided on the inner side walls of the grip. The frame has two shoulders between which the loop is located, the shoulders being interconnected from one side by a member which is provided with a tooth which abuts against a support of the lever when the frame is in the closed position. The lever has an upper arm on the end of which a lug is located from above, which lug trough an opening in a rear wall is disposed on the level of the surface of the grip a lower arm on the end of which a support is located from below and a projection is located from above, onto which projection a return spring is set, the return spring abutting with its other end against a depression in the bracket, the return spring, when extended, retaining, owing to the support which grips the tooth, the frame in the closed position, and, with the return spring (156) contracted, when under the pressure of the shooter's finger on the lug the lever turns on the axle, releasing the tooth from the support, the frame assumes its open position. The loop has shoulders which are lifted with respect to its central part towards the frame: a shoulder in the form of a horizontal platform and a cylindrical shoulder with an opening which is perpendicular to the axis of the screw and in which the turning axle is disposed. The hold-down member which closes from below the frame with the loop and the screw has a cam which extends above the flat part of the hold-down member, is mounted through the opening on the axle of rotation on the frame between its shoulders, and presses with its profiled side the shoulder of the loop when the hold-down member is in the closed position, a depression on the inner side to receive the link of the screw, angular supports disposed from the side of and symmetrically to the cam and, adjoining the platforms of the lugs, insures stopping the hold-down member in the open position; when an external side of the hold-down member is found at a certain distance from the tooth of the lower arm of the lever and does not affect it; edges disposed behind angular supports along the edges of the inner side of the hold-down member and adjoining the platforms of the bracket when the hold-down member is in the closed position; lugs located in the corners on the external side of the hold-down member, facing the magazine.

The load via a through longitudinal opening provided therein is set onto the barrel and is secured by pins through openings to the barrel owing to depressions disposed on the barrel perpendicular to the axis thereof, in which the pins (are partially received; in front of the longitudinal opening in the load a cylindrical depression is disposed; behind the longitudinal opening there is a rear space, from below along the edges of the load two longitudinal support limiters are disposed, movable along the support as the barrel moves longitudinally; from below on one of the limiters a projection is disposed with a pivot; between the limiters under the longitudinal opening which is separated by a partition there is a groove defined from the front by a projection and from the rear by an inclined wall, on whose end opposite the projection with the pivot there is a cutout; from below in the cylindrical depression in front of the projection a through groove is disposed. In the front part of the through groove perpendicular to the direction of travel of the load a pin is disposed, adapted to interact with an auto-sear and secured on the load through openings disposed in the support limiters.

The magazine made in the form of a prism has a flat cover which is rigidly secured to the magazine and at the same time is a rear wall of the magazine, which adjoins a partition in the grip; the magazine is closed from above by a horizontal shelf disposed in the upper part of the cover perpendicular to the surface thereof; the magazine is limited from below by a base; the magazine is provided with an oval passage to accommodate the containers with the bullets.

Onto the base of the magazine a shoe is set, on whose inner side facing the base there are two platforms disposed symmetrically at the edges thereof, which platforms lie down onto the lugs of the hold-down member and serve as a stop for the magazine after installing thereof in the grip. The shoe has an opening whereinto a head of a button is received under the pressure of a spring installed in a depression from below of the base of the magazine. The oval passage along which the containers move comprises two vertical, straight, parallel passages separated by a partition, a passage for supplying the loaded container for shooting and a passage for removing the empty container after shooting, interconnected from above and from below by semi-round passages. The width of the oval passage is equal to the outer diameter of the cylindrical part of the container and the length is such that the clearance between two containers standing one next to another is always smaller than the width of the platform of the finger, for the containers to move freely along the oval passage. In the upper part of the magazine under the horizontal shelf there is an opening in which a block is disposed, whose two lateral projections rest on the side shelves disposed inside an opening. From above in the block depressions are provided for springs which bias the block away from the horizontal shelf of the cover. From the side of the oval passage a wall of the block is concave, its radius of rounding being equal to the outer radius of the cylindrical part of the container for stable location of the container before the shot opposite the bullet opening in the front wall of the magazine coaxially with the valve and with the bullet bore. On an inner side of the upper part of the cover in a depression a part of a flat leaf spring is disposed, which through openings therein is secured by pins installed in the end face part of the partition and in depressions of the cover, the other part of the leaf spring being located in a cutout disposed in the cover under the depression, the upper end of the leaf spring lying on a bearing side of the horizontal shelf. On the inner side of the upper part of the cover above the place of junction of the passage for removing the empty container with the upper semi-round passage, there is disposed a semi-round depression which eliminates jamming of the containers. The container is a hollow cylinder having a barrel side disposed from the side of the barrel after locating the container in the magazine, and a valve side adjoining the inner side of the cover of the magazine, and face sides; on the inner side of the container longitudinal recesses are disposed and tail projections, located nearer to the valve side, which insure retention of the bullet inside the container after loading thereof. The bullets used for loading into the container are spherical or cylindrical or spindle-shaped and are made from iron or have an iron tip, or are made from a softer metal or plastic. Above the oval passage in the cover of the magazine for loading the containers with the bullets an opening is provided, whose width is smaller than the external diameter of the cylindrical part of the container, but larger than the diameter of the bullet. On the right side wall of the magazine there is a step which supports a bend of a rocker arm. On the left side wall of the magazine there is an oblong opening, whose width is smaller than the longitudinal size of the container, for moving the containers by the shooter's finger when loading the magazine. On the front wall of the magazine a horizontal projection is disposed, with which the magazine abuts against a lower end face of the rear wall of the support; under the projection there is a depression for locating a head of a lock of the magazine; above the projection in the front wall there is a large opening for the finger above the passage for supplying the container to the shooting position and a small opening for the limiter above the passage for removing the empty container from the shooting position; above the bullet opening a cutout is provided to receive a lug, disposed above the opening in the rear wall of the upper rear projection of the support. The size and shape of the large opening and of the small opening coincide, respectively, with the opening for the finger and with the opening for the limiter, provided in the rear wall of the support, and are also disposed, respectively, one opposite the other after installing the magazine in the grip.

In the upper part of the body of the valve opposite the magazine a ring-shaped saddle is provided, inside which a hollow cylinder of the valve is located, the end face part of the cylinder enters the cutout in the upper part of the cover of the magazine and abuts against the flat leaf spring which limits from the front the travel of the valve with the cylinder, the valve installed coaxially with the bullet bore of the barrel and with a throttle opening in the leaf spring being in the closed state, when the spring is extended and the valve is pressed to the saddle or makes up a clearance with the saddle, when after a short-time action of the leaf spring on the cylinder of the valve the spring is compressed, for a portion of gas to come from the gas chamber to the cylinder of the valve. Between the saddle and the valve an annular cup is disposed, which precludes coming of a portion of gas to the cylinder when the valve is closed. Between the body of the valve and the saddle in an annular groove provided on the side of the saddle which adjoins the body a seal is disposed, which precludes gas leakage from the gas chamber.

The support has a base arranged in the hollow interior (of the pistol frame; from above the base, above the pistol frame there are disposed a rear projection next to the magazine and a front projection with a hollow cylinder disposed ahead of it; in the middle part of the base of the support a through vertical passage is located for accommodating a sear; in front in the base there is a depression for a rod; from above the base, between the depression for the rod and the through passage, there is a groove for an auto-sear; on the other side of the through passage in the base there is a through longitudinal groove for a trigger, the through longitudinal grove being combined with a depression disposed under the rear projection and in which a larger arm of the trigger, the finger and the limiter are located, disposed on different sides relative to the larger arm of the trigger; in the rear wall of the support there are a large opening for the finger and a small opening for the limiter. In the groove for the auto-sear, a lowering member made as a pin secured in the side walls of the base of the support is disposed perpendicular to the direction of movement of the barrel. The end face part of the hollow cylinder extends above a front wall of the breech block through an opening. In the front projection with the cylinder and in the rear projection openings are disposed, through which the barrel is installed in the support so that the load secured on the barrel is disposed behind the front projection, and in a rear space of the load the rear projection of the support is disposed, the openings in the projections serving as pilot holes when the barrel moves relative to the support. In the lower part of the rear projection from the side of the load there is a step for cutouts provided on support limiters of the load, the step fixing the rearmost position of the barrel when it moves toward the magazine. From the outside on the right side wall of the through groove for the trigger there is a cutout for the projection of the load. Along the left side wall of the through groove for the trigger there is a guiding projection which rises above the base and is adjacent to the inner side of the support limiter of the load, excluding transverse displacement of the load relative to the support and fixing the axle of the auto-sear against dropping out from the trigger. On a rear wall of the rear projection above the opening a lug is disposed.

The pistol has a buffer spring set onto the barrel and located between the inner wall of the rear space of the load and the front wall of the upper rear projection of the support and a mainspring set onto the barrel and installed between an inner wall in a cylindrical depression of the load and a wall of a depression provided in the rear part of the upper front projection of the support.

On inner side walls in the rear part of the breech block, cutouts are made from below, into which projections are installed, disposed on side walls of the body of the valve, when the breech block is set from above onto the pistol frame; the cutouts are connected with horizontal grooves disposed along inner side walls, in which horizontal grooves the projections are disposed, when the breech block, moving along the pistol frame, occupies the rearmost position and proves to be fit tightly onto the pistol frame; in the front wall of the breech block an opening is disposed for the cylinder of the support, and under it an opening for a rod is disposed; in the rear wall of the breech block a groove is disposed for accommodating a head of a hammer, this groove being defined from the front by a strap and abutting by its edge against a partition. The length of the horizontal grooves is greater than the distance between a front wall of the upper front projection of the support and an inner side of the front wall of the breech block.

The pistol has a rod which with its one end, having a cylindrical head whose diameter is greater than the cross-section of the rod, is installed in a depression provided in the base of the support under the upper front projection parallel to the axis of the cylinder, a return spring being located on the rod between the head and the inner side of the front wall of the breech block, the return spring being compressed when the breech block is installed on the pistol frame, the other end of the rod being disposed in a lower opening on the front wall of the breech block, ruling out casual jumping of the breech block off the pistol frame.

The pistol has two stops and two buttons with blocks, disposed on different sides of the base of the support, ruling out casual jumping of the breech block off the pistol frame. Each stop which comprises a plate with a projection in its middle part is disposed in a horizontal groove located under the lowering member in the front part of the base of the support parallel to the direction of movement of the barrel. The projection of the stop is disposed in a deep groove which limits the displacement of the stop in the horizontal groove under the action of a spring installed in the deep grove between its rear wall and the projection. A part of the stop is made with a longitudinal oval groove to limit dropping out of the spring from the deep groove. Each button is disposed inside the pistol frame, and a pilot projection on an outer side of the button through an opening in the pistol frame extends above its lateral side and can move vertically along this opening, the button with its side opposite the projection being able to move along a vertical groove disposed on the lateral side of the base of the support, as well as to move above a part of the horizontal groove, in front of the through passage for the sear. Each block is located on a spring in a depression disposed in a vertical groove in the side wall of the base under the horizontal groove; when a conical head of the block sinks in a lower depression provided on the inner side of the button, the button assumes its upper position, a depression provided in the upper part on the inner side of the button becomes disposed above the horizontal groove, blocking the movement of the stop, whereby stable position of the breech block on the pistol frame is fixed; when the conical head of the block sinks in an upper depression of the button, the button assumes its lower position, the depression becomes disposed opposite the horizontal groove and releases the stop for free movement.

The striker-and-trigger mechanism comprises a trigger mounted on an axle which through openings provided in a lower middle part of side walls of a groove of the support is secured on the pistol frame; an auto-sear disposed between the lowering member and the trigger under the barrel in the support; a sear installed in a through vertical passage of the support; a trigger bar located inside the pistol frame between the pistol frame and the support and interconnecting the load and the hammer which is installed in a depression provided in the rear part of the pistol frame in front of a partition separating the body of the valve from the depression, the hammer being mounted through openings in the hammer on an axle of rotation installed in openings provided in a lug and in a rounded lug, each of them being disposed on its respective internal partition which rule out transverse displacement of the hammer; a finger and a limiter disposed in a depression in the rear part of the support opposite each other on different sides of the trigger, opposite a large opening and a small opening respectively, disposed in a rear wall of the support. The hammer has a head for the shooter's thumb, a lateral shoulder with a pivot at the end thereof, the lateral shoulder being located inside a groove defined by the internal partition and by the side wall of the pilot frame; a lower projection for interacting with a safety lock, a groove disposed below between the lateral shoulder and the lower projection for accommodating the rounded lug. The trigger bar through an opening is set with its one end onto the pivot of the hammer and through an opening it is set with its other end onto the pivot of the load, insuring the backward travel of the load with the barrel when the hammer is cocked or ruling out the travel of the load with the barrel when the hammer is blocked by the safety lock. The trigger has a triggering arm in the lower part thereof and two smaller arms in the form of a fork in the upper part thereof, the smaller arms terminating with a radius part interacting with an inclined wall of the groove of the load; a decoupling projection in front for interacting with the sear, and a larger L-shaped arm in the rear, which interacts with the finger and with the limiter. At the end of the larger arm in an opening an axle of rotation is located, on which lower parts of the finger and of the limiter are mounted. The auto-sear has a short arm which is disposed between the smaller arms of the trigger on an axle secured in the smaller arms and smoothly passes into a longer arm which terminates with a bevel which interacts with a lowering member and is disposed at an angle to a bearing side of a bolt camming lug which interacts with a pin of the load and is disposed from above of the longer arm, the auto-sear having a horizontal bearing platform between the bevel and the bearing side. The end part of the short arm of the auto-sear is connected by a pressing spring to the upper part of the larger arm of the trigger. The sear is made as a rectangular parallelepiped having a depression below, in which a spring is disposed, which abuts against the trigger bow inside the pistol frame; in the lower part on the side facing the trigger a projection is provided, whose end part through a lower slit in a separating partition which defines a through passage in the support, is located in a groove for the trigger; the projection adjoins with its upper inclined edge the decoupling projection of the trigger, the guide of the projection coinciding with the guide of the groove which is located in the upper part of the sear between two shoulders and in which a part of the longer arm of the auto-sear is disposed. With the trigger in normal position, when its cocking arm is not pressed by the shooter's finger and the inclined edge of the projection does not adjoin the decoupling projection, the sear under the action of the spring is found in the uppermost position, presses on the load from below, the bearing platform of the auto-sear abuts against the pin of the load and blocks the movement of the barrel with the load, thus ruling out the possibility of a casual shot. The sear can move down along the through passage in the support under the pressure exerted by the decoupling projection of the trigger on the projection of the sear, when the cocking arm of the trigger is pressed by the shooter's finger, the auto-sear under the action of the smaller arms of the trigger moving forward along the groove in the support, the mainspring becomes compressed, and the buffer spring becomes extended, since the barrel moves forward under the pressure exerted by the bearing side of the auto-sear on the pin of the load till the bearing side of the bolt camming lug gets loose from the pin of the load, whereafter a shot takes place, the sear assumes the lower-most position, the auto-sear is found below the pin and does not interfere with the load and the barrel moving backward. The finger has an inclined edge adjoining a lower edge of a large opening in a rear wall of the support, which hinders the turn of the finger relative to the trigger; on a lateral side of the finger, facing the trigger, there is a lateral projection, this lateral projection lying down on an inner side of the wall of the support, when the inclined edge ceases to adjoin the lower edge of the opening after the trigger is pulled; in the middle part of the inclined edge there is a step, next to which an opening is provided to receive a bent end of the return spring; the place of junction of an upper edge with the inclined edge terminates with a projection rounded from above and having a vertically arranged platform in the front part thereof. The return spring of the finger is secured with its other bent end on a pin installed in side walls in openings in the rear part of the support. The finger is able to turn relative to the trigger, when, as the trigger is pulled, the bearing side of the bolt camming lug of the auto-sear ceases to adjoin the pin of the load under the action of the lowering member on the bevel of the auto-sear; the rounded projection of the finger, abutting against the upper edge of the large opening in the rear wall of the support, comes out above the surface of the rear wall of the support and through the large opening in the front wall of the magazine enters a container with a bullet for supplying this container to the shooting position. The limiter has an inclined edge adjoining the lower edge of the small opening in the rear wall of the support, which hinders the turn of the finger relative to the trigger; on a lateral side of the finger, facing the trigger, there is a lateral projection, this lateral projection lying down on an inner side of the rear wall of the support, when the inclined edge ceases to adjoin the lower edge of the small opening after the trigger is pulled; in the middle part near the inclined edge an opening is provided to receive a bent end of the return spring; the place of junction of an upper edge with the inclined edge terminates with a projection rounded from above. The return spring of the limiter is secured with its other bent end on the same pin as the return spring of the finger. The limiter is able to turn with respect to the trigger through the same angle as the finger, when, as the trigger is pulled, the bearing side of the bolt camming lug of the auto-sear ceases to adjoin the pin of the load under the action of the lowering member on the bevel of the auto-sear, the rounded projection of the finger, abutting against the upper edge of the small opening in the rear wall of the support, comes out above the surface of the rear wall of the support and through the small opening in the front wall of the magazine enters an empty container for removing it from the shooting position after the shot.

The pistol has a safety lock, a lock and a detent for blocking the hammer to rule out a casual shot. The safety lock has a thumb piece with a ledge, which adjoins from the outside the surface of the pistol frame, a cylinder with a flat, disposed perpendicular to the surface of the thumb piece, a projection disposed between the ledge and the cylinder and having a groove made on the side opposite the place where depressions are located, perpendicular to the axis of symmetry of the cylinder, and a pivot disposed on an end face side of the cylinder, the projection and the cylinder being located in an opening in the pistol frame. The pivot is located in an opening disposed under a rounded lug in a partition separating a depression adapted to receive the hammer from a groove in which a lateral shoulder of the hammer is located. On the ledge opposite a detent two depressions are provided, a head of the detent being disposed in an upper depression, when the thumb piece is in the uppermost position, and the flat of the cylinder assumes a horizontal position and releases the projection of the hammer for it to be cocked or is disposed in the lower depression, when the thumb piece is in the lowermost position and the flat assumes an inclined position and blocks the hammer, ruling out a shot. The lock has an L-shaped projection in whose upper part there is an opening through which the lock is mounted on an axle of rotation of the hammer, when a lower part of the lock is disposed in a groove which is found between the partition that separates the depression adapted to receive the hammer and the wall of the pistol frame, a leg of the L-shaped projection being inserted into the groove and fixing the position of the safety lock in the pistol frame. The detent is installed in an opening of the pistol frame, and its conical head under the pressure of a spring located in an opening between a side wall of the body of the valve and the detent sinks in one of depressions on the ledge of the safety lock, fixing the position of the safety lock relative to the hammer.

The pistol has a latch and a lock for retaining the magazine in the grip. The latch has two flat cheeks, each of these cheeks having a configured front projection, a lower projection and a cross member which interconnects the upper parts of the cheeks and has a cutout from below for a spring of the latch; through openings in the cheeks the latch is mounted on an axle disposed in an opening in a narrowing of the trigger bow, the configured projections of the cheeks through openings in the body of the grip, disposed symmetrically relative to the trigger bow, are found on different sides of the narrowing of the trigger bow. Between the cross member of the latch and the inner wall of the body of the grip a spring is installed. The lock which is located between the cheeks of the latch and adjoins the cross member from the side opposite the front configured projections of the latch is made as a lever, whose lower part is made as an unlocking fork having two arms which through openings provided therein are mounted on an axle installed in an opening of a lug disposed between the arms of the lock on a projection disposed inside the body of the grip on the trigger bow; on the end of each arm from the outside there is a projection, arranged perpendicular to the lateral edge of the arm of the lock and adjoining a rear inclined edge of a lower projection of the lock; in the middle of the lock, on the side facing the latch, a depression is provided to receive a spring of the lock; in the upper part of the lock from the side of the magazine a head is disposed, which sinks in a depression on the front wall of the magazine (27), fixing the position of the magazine in the grip, when the front configured projections of the latch occupy the uppermost position and the cross member exerts pressure on the upper part of the lock or leaves the depression in the front wall of the magazine, releasing the magazine to move in the grip, when the front configured projections of the latch under the action of the shooter's finger take the lower-most position and the rear inclined edges of the projections of the latch exert pressure on the projections of the lock. In the depression of the lock a spring is disposed, which abuts with its other end against a projection on the trigger bow.

The pistol has a rocker arm and a slide stop for retaining the breech block on the pistol frame. The slide stop through an opening disposed in the lower part thereof is mounted on an axle of the trigger inside the pistol frame and has in front an inflexion disposed in a cutout on the end face of the side wall of the pistol frame, with a bent away button disposed from the external lateral side of the pistol frame; under the inflexion an opening is provided for accommodating a carrier of the rocker arm; from below in the middle of the slide stop there is a projection, onto which a spring is set, whose other end is installed in a depression disposed inside the pistol frame so that it presses the slide stop to the breech block. The rocker arm has a short shoulder, wherein there is an opening through which the rocker arm is mounted on an axle in a groove of the pistol frame, and a long shoulder, whose end part is disposed in a groove in the pistol frame, and a bend disposed in the middle part thereof adjoins a step on the side wall of the magazine; on the end of the short shoulder of the rocker arm there is a carrier bent away in the same direction as the bend, the carrier entering an opening in the slide stop, the rocker arm being able to rotate on an axle within the opening till it abuts against the lower wall of the groove.

BRIEF DESCRIPTION OF THE DRAWINGS

FIG. 6 is a general rear view of an empty frame of the pistol with a grip without a breech block;

FIG. 7 is a general view of the pistol breech block;

FIG. 8 is a side elevation view of the breech block;

FIG. 11 is a general front top view of the support of the pistol;

FIG. 12 is a right side sectional elevation view of the support of the pistol;

FIG. 13 is a general rear bottom elevation view of the support of the pistol;

FIG. 43 is a general rear top view of the bracket of the pistol;

FIG. 44 is a general rear bottom view of the bracket of the pistol;

FIG. 45 is a general view of the lever of the pistol;

FIG. 46 is a general front view of the finger of the pistol;

FIG. 47 is a left side elevation view of the finger of the pistol;

FIG. 48 is a general front view of the limiter of the pistol;

FIG. 49 is right side elevation view of the limiter of the pistol;

FIG. 50 is a side elevation view of the rod of the pistol;

FIG. 51 is a general front view of the block of the pistol;

FIG. 52 is a front sectional elevation view of the block of the pistol;

FIG. 53 is a front elevation view of the leaf spring of the pistol;

BEST WAY OF CARRYING OUT THE INVENTION

Figure 1:
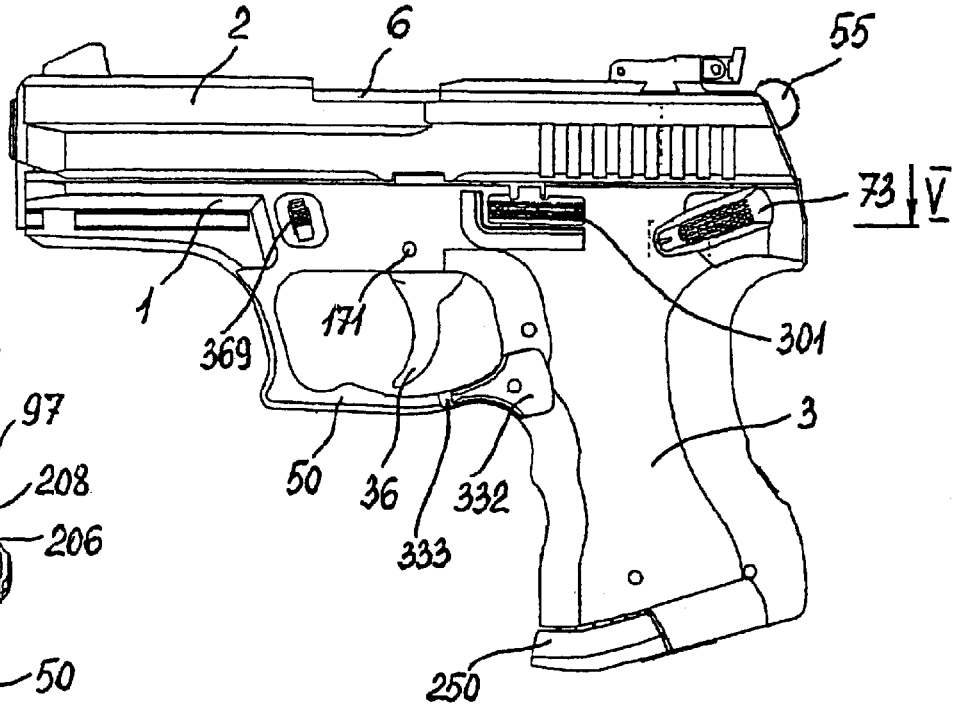
FIG. 1 is a right side view of the pistol.
Figure 2:
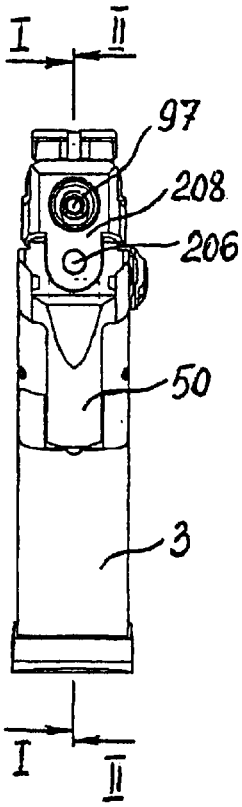
FIG. 2 is a front view of the pistol.
Figure 3:
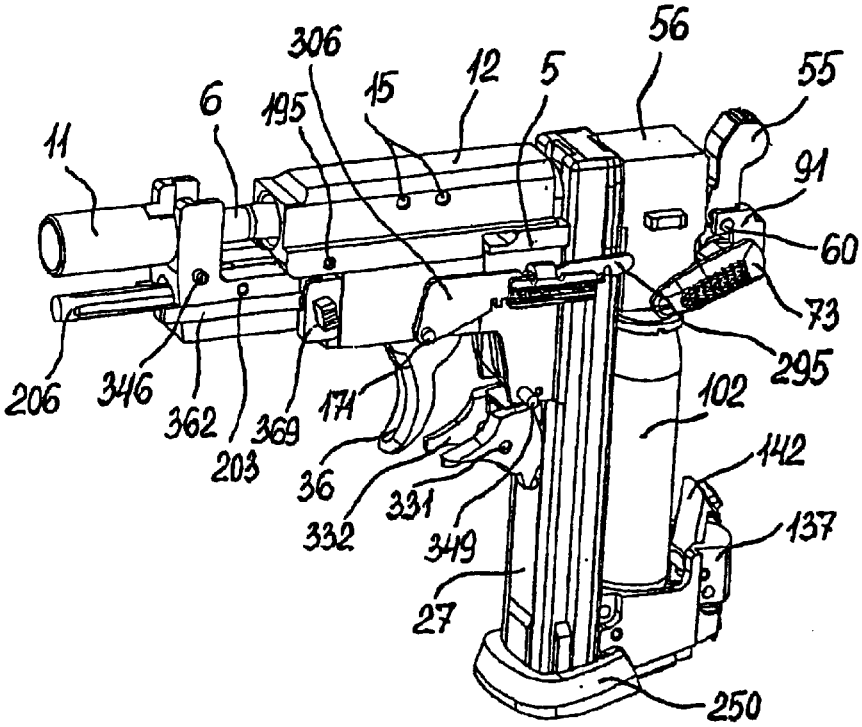
FIG. 3 is as general right side view of the pistol without a frame, grip and breech block.
Figure 4:
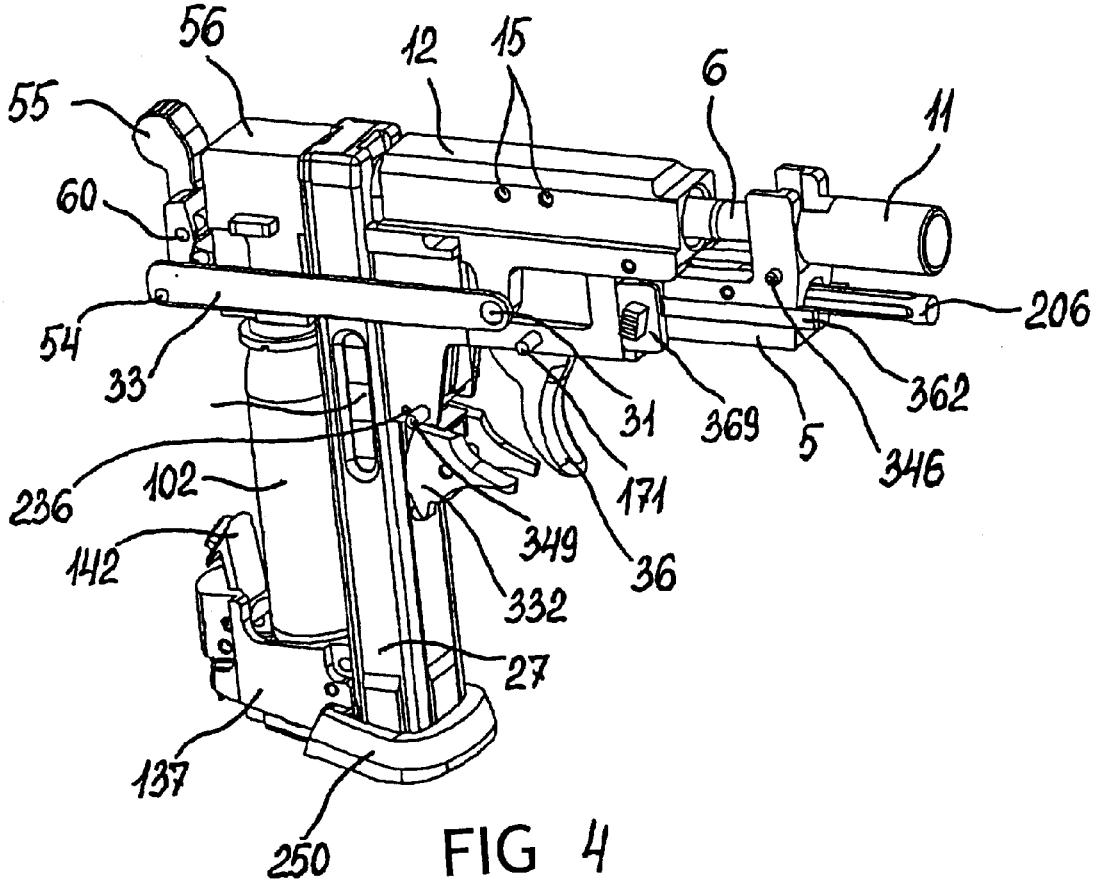
FIG. 4 is a general left side view of the pistol without a frame, grip and breech block.
Figure 5:
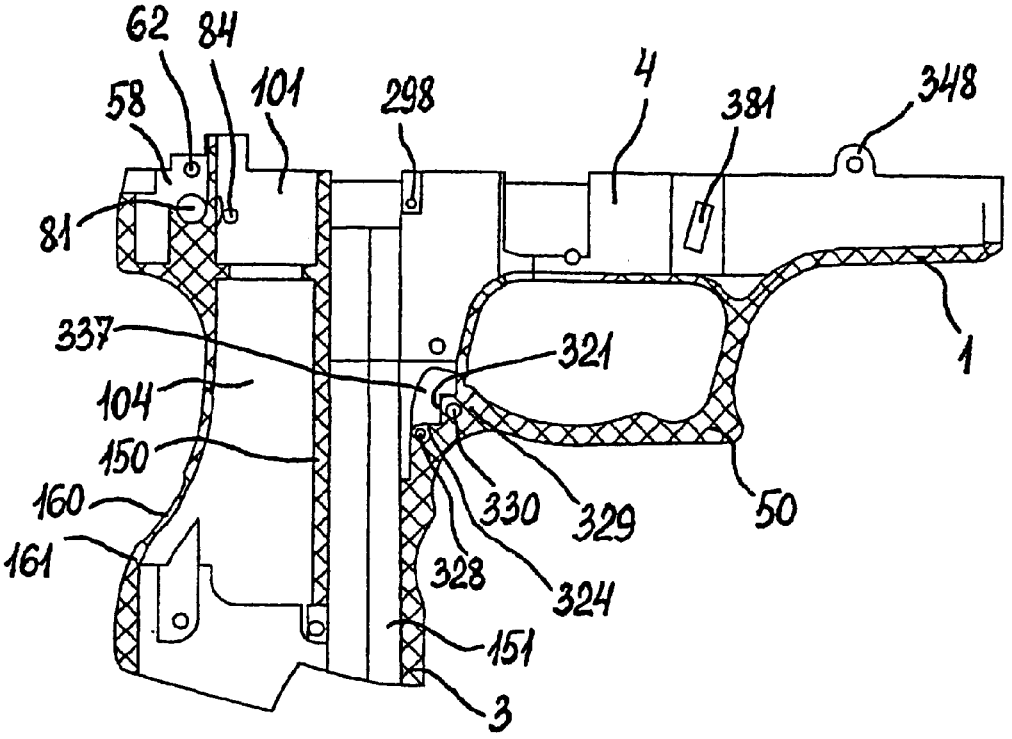
FIG. 5 is a section taken along I—I in FIG. 2, showing an empty frame of the pistol with a grip, without a breech block.
Figure 9:
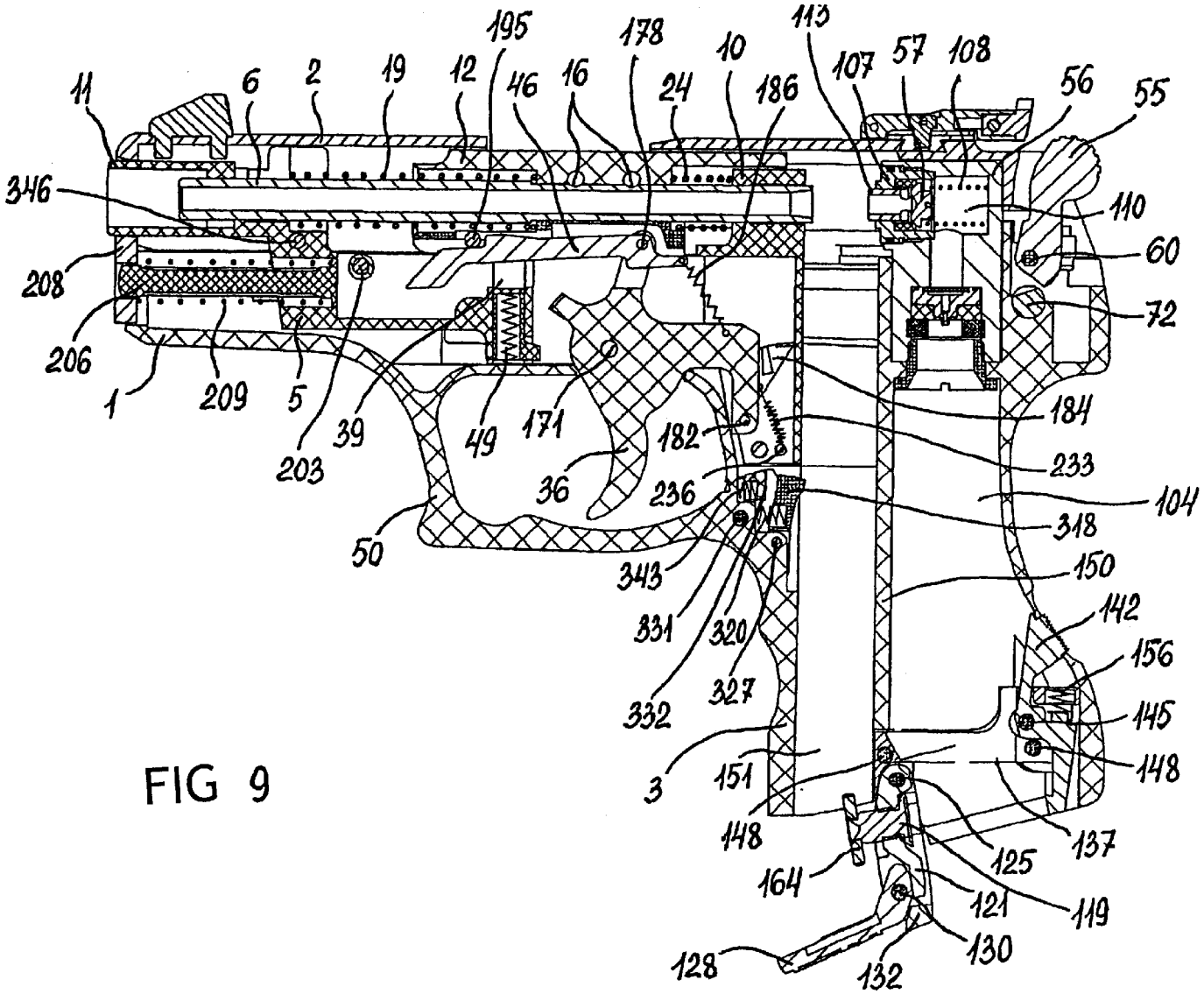
FIG. 9 is a section taken along II—II in FIG. 2, showing the pistol in assembly, without a magazine, gas cylinder and springs, with the barrel in the rearmost position.
Figure 10:
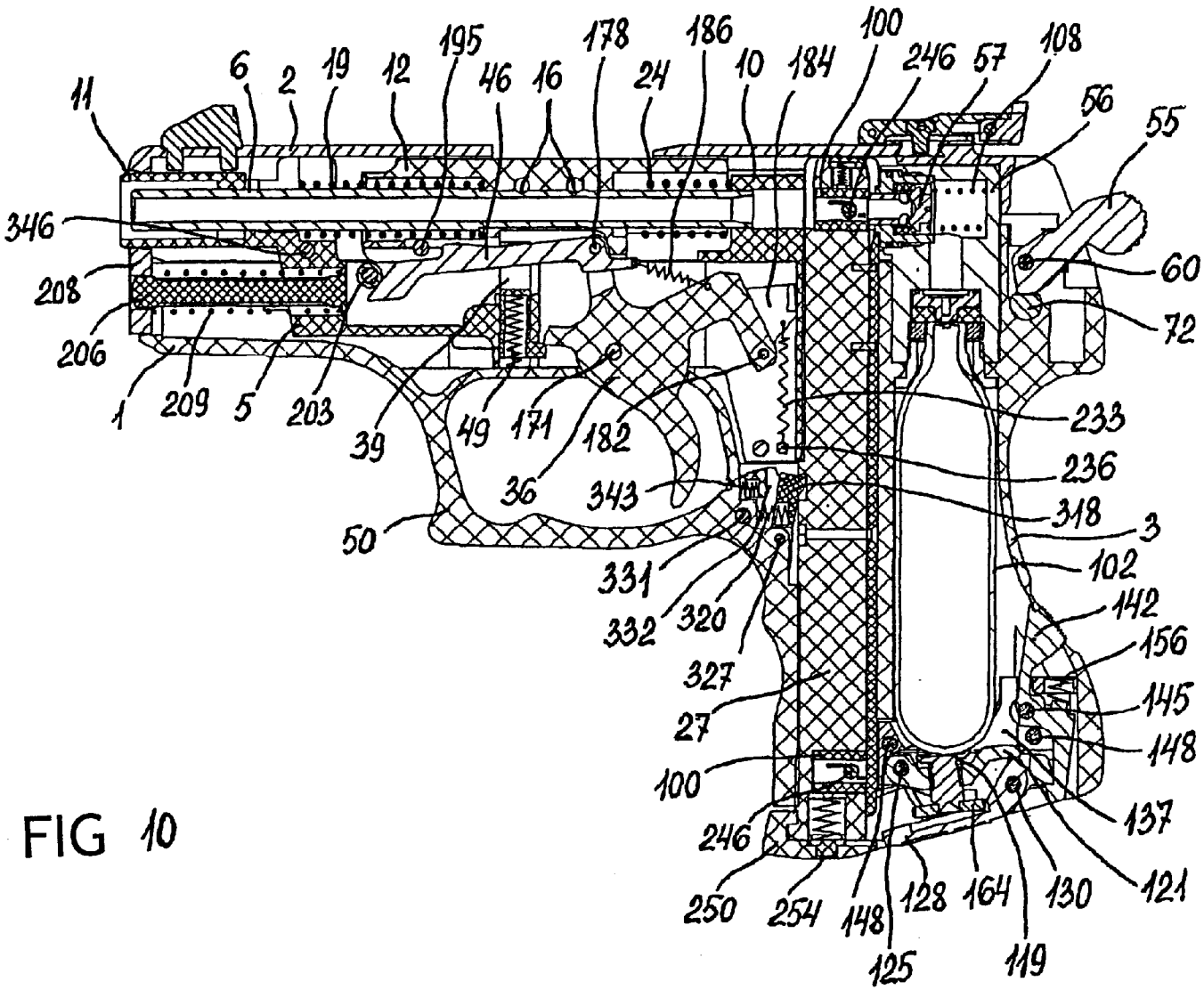
FIG. 10 is a section taken along II—II in FIG. 2, showing the pistol in assembly with a magazine and a gas cylinder, sear notch engaged.

A repeating gas cylinder pistol (FIGS. 1–4), embodied according to the invention, comprises a hollow pistol frame 1 (FIGS. 5, 6) with a pistol breech block 2 (FIGS. 7, 8) the lower part of the pistol frame 1 being a grip 3 of the pistol. In a hollow interior 4 (FIG. 6) of the pistol frame 1 (FIGS. 9, 10) under the breech block 2 a support 5 is installed (FIGS. 11–13). The support 5 serves as a base for a movable barrel 6 that moves relative thereto. The barrel 6 moves along a front pilot cylindrical hole 7 and a rear pilot cylindrical hole 8 located in an upper front projection 9 and a lower projection 10, respectively, and in the rear part of a cylinder 11 of the support 5, disposed in front of the upper front projection 9.

Figure 14:
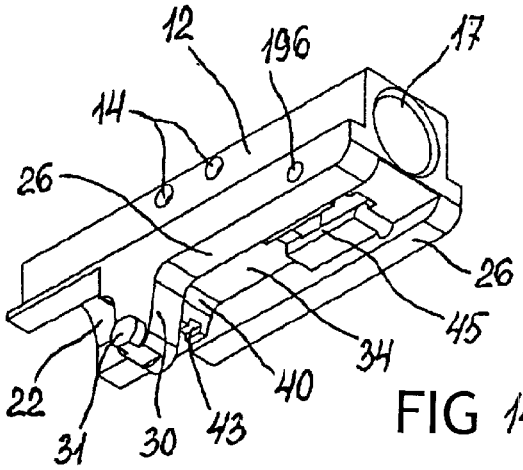
FIG. 14 is a general front view of the load of the pistol.
Figure 15:
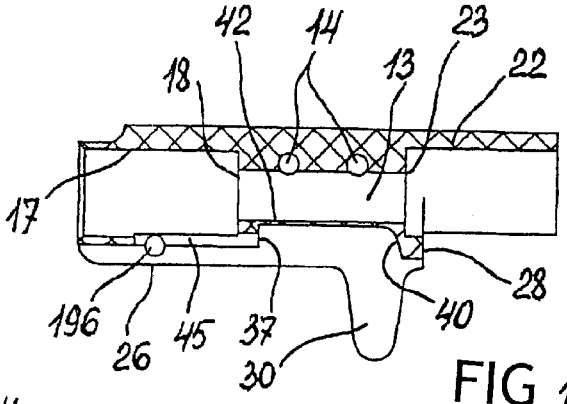
FIG. 15 is a right side sectional view of the load of the pistol.
Figure 16:
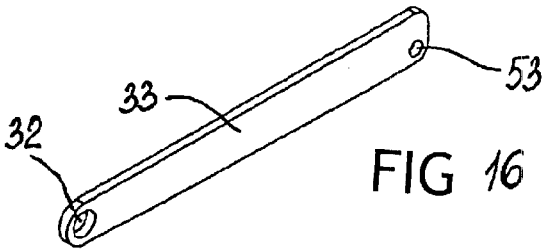
FIG. 16 is a general view of the trigger bar of the pistol.
Figure 17:
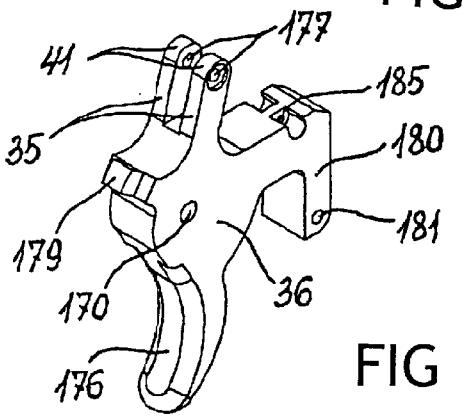
FIG. 17 is a general front view of the trigger of the pistol.
Figure 20:
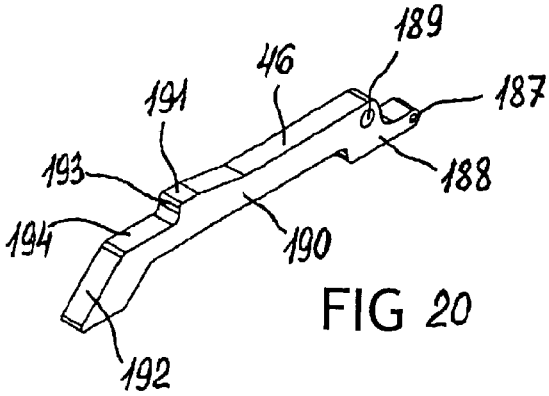
FIG. 20 is a general front view of the auto-sear of the pistol.
Figure 18:
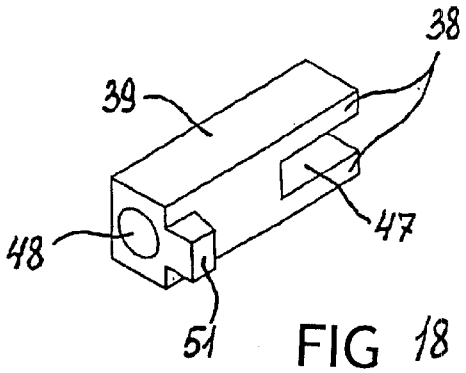
FIG. 18 is a general bottom view of the sear of the pistol.
Figure 19:
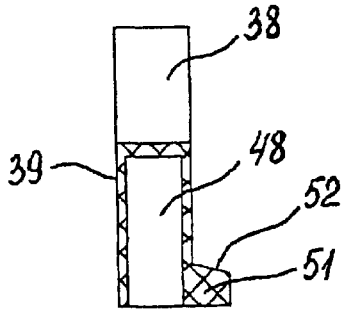
FIG. 19 is a side sectional view of the sear of the pistol

On the barrel 6 a load 12 is located (FIGS. 14, 15), which, owing to the provision in the middle part thereof of a through longitudinal opening 13 whose diameter coincides with the outer diameter of the barrel 6, proves to be set onto the barrel 6. The load 12, through openings 14, is rigidly secured with the help of two pins 15 to the barrel 6 due to the provision of two recesses 16 located on top of the barrel 6 perpendicular to its axis, in which recesses the pins 15 are partially disposed. In the front part of the load 12 a cylindrical recess 17 is provided, whose diameter is larger than the diameter of the barrel, wherein a mainspring 19 is disposed and abuts against inner wall 18 of the recess 17, which spring 19 is set onto the barrel 6, and the other end of which spring abuts against a wall 20 of a recess 21 provided in a rear part of the upper front projection 9 of the support 5. In the rear part of the load 12 there is a space 22, whose size is larger than the diameter of the barrel 6; in this space 22 a buffer spring 24 is disposed, said spring being set onto the barrel 6 and abutting against an inner wall 23 of the space 22, the other end of the buffer spring 24 abutting against a front wall 25 of the upper rear projection 10 of the support 5. On the lower part of the load 12 on both sides thereof there are two longitudinal support limiters 26 which adjoin the support 5 and preclude turning of the load 12 relative to the support 5. From the side of a magazine 27 the support limiters 26 are provided with cutouts 28, a step 29, which is disposed in the lower front part of the rear projection 10 of the support 5 and limits the travel of the barrel 6 with the load 12 towards the magazine 27, abutting against the cutouts 28. From below in the left part of the load 12 on one of the limiters 26 a projection 30 with a pivot 31 is provided, the pivot 31 being disposed in a front opening 32 of a trigger bar 33 (FIG. 16). Between the two support limiters 26 there is a groove 34 for locating a smaller arm 35 of a trigger 36 (FIG. 17). From the front the groove 34 is limited by a projection 37, shoulders 38 of a sear 39 abutting against it (FIGS. 18, 19). From the rear the groove 34 is limited by an inclined wall 40, a radius part 41 of the smaller arm 35 of the trigger 36 abutting against said inclined wall 40 as the load 12 moves forward towards the front opening 7 of the support 5. The groove 34 is located directly under the longitudinal opening 13 and is separated from it by a partition 42. On the end of the wall 40 opposite the projection 30 there is a cutout 43 to receive a guiding projection 44 of the support 5. In the lower part of the recess 17 a through groove 45 is disposed for receiving an auto-sear 46 (FIG. 20).

The sear 39 (FIG. 18) is a rectangular parallelepiped whose upper part is made in the form of two shoulders 38 with a groove 47 therebetween. From below, the sear 39 is provided with a depression 48 in which a spring 49 is disposed, the other end of the spring 49 abutting against the inner wall of the upper part of a trigger bow 50. In the lower part of the sear 39 a projection 51 is disposed that has an upper inclined edge 52. The guide of the projection 51 coincides with the guide of the groove 47.

In the pistol frame 1, between its side wall and the support 5, a trigger bar 33 is disposed (FIG. 16) in the form of a flat elongated plate. On the front end of the trigger bar 33 there is an opening 32 into which the pivot 31 of the projection 30 of the load 12 is inserted. On the other end of the trigger bar 33 an opening 53 is provided, in which a pivot 54 of a hammer 55 is disposed.

Figure 21:
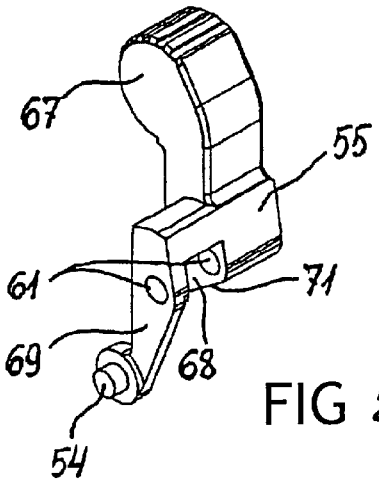
FIG. 21 is a general front view of the hammer of the hammer of the pistol.
Figure 22:
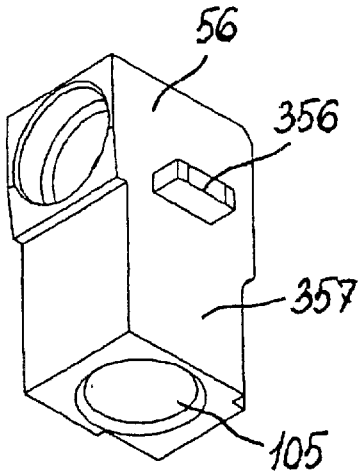
FIG. 22 is a general front view of the valve body of the pistol.
Figure 23:
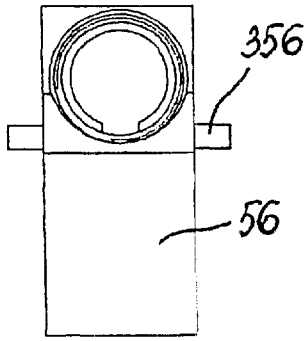
FIG. 23 is a front elevation view of the valve body of the pistol.
Figure 24:
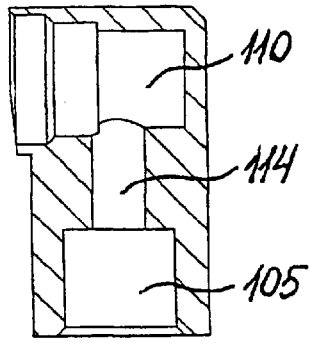
FIG. 24 is a right side sectional elevation view of the valve body of the pistol.
Figure 25:
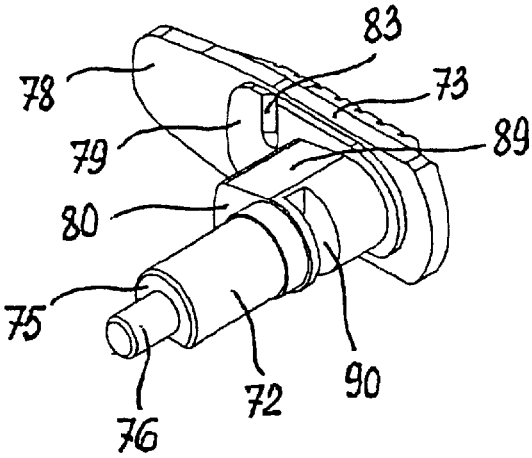
FIG. 25 is a general rear view of the safety lock of the pistol.
Figure 26:
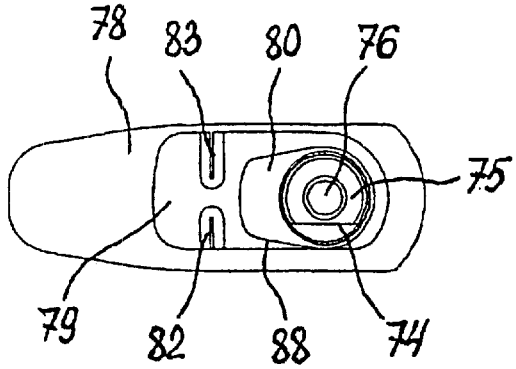
FIG. 26 is a rear elevation view of the safety lock of the pistol.

The hammer 55 (FIG. 21) is located directly after a body 56 (FIGS. 22–24) of a valve 57 (FIG. 9) in a depression 58 disposed in the pistol frame 1 in front of a partition 59 that separates the body 56 of the valve 57 from the depression 58. The hammer 55 is disposed on an axle of rotation 60, inserted into openings 61 in the hammer and secured in the rear upper part of the pistol frame 1 in openings 62 (FIG. 6) provided in a lug 63 and in a rounded lug 64 located on internal partitions 65 and 66, respectively, which rule out transverse displacement of the hammer 55 along an axle 60. The hammer 55 has a head 67 for the shooter's thumb, a groove 68 to receive the lug 64, a lateral shoulder 69 with the pivot 54 in the lower part thereof, said lateral shoulder being disposed in a groove 70, a lower lug 71 interacting with a cylinder 72 of a safety lock 73 (FIGS. 25, 26).

The cylinder 72 of the safety lock 73 has a flat 74 for a free turn of the lower lug 71 of the hammer 55. On an end side 75 of the cylinder 72, adjoining the partition 66 in the pistol frame 1, a pivot 76 is located, which is disposed in a lower opening 77 of the partition 66. On the end face opposite the pivot 76 the safety lock 73 has a thumb piece 78 with a ledge 79, which adjoins from the outside the surface of the pistol frame 1. Between the cylinder 72 and the ledge 79 a projection 80 is located, which is disposed in an opening 81 provided in the pistol frame 1. On the side of the ledge 79, adjoining the surface of the pistol frame 1, an upper depression 82 and a lower depression 83 are provided.

Figure 27:
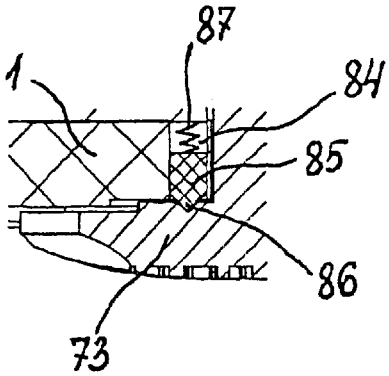
FIG. 27 is a sectional view of the detent with the safety lock of the pistol.

Opposite the depressions 82 and 83, in the pistol frame 1, perpendicular to the surface thereof, there is an opening 84, closed from one side by the wall of the body 56 of the valve 57. In the opening 84 a detent 85 is disposed (FIG. 27), whose conical head 86 under the action of a spring 87 arranged in the opening 84 between the body 56 of the valve 57 and the blunt side of the detent 85, enters the depression 82 or 83. When a head 86 of the detent 85 proves to be in the depression 82, the flat 74 takes a horizontal position and makes room for the lower lug 71 of the hammer 55 to turn. An upper edge 88 of the projection 80 adjoins an upper wall of the opening 81. When the head 86 of the detent 85 is in the depression 83, the flat 74 takes such an inclined position that the cylinder 72 of the safety lock 73 blocks the turn of the hammer 55. A lower edge 89 of the projection 80 adjoins the lower wall of the opening 81.

Figure 28:
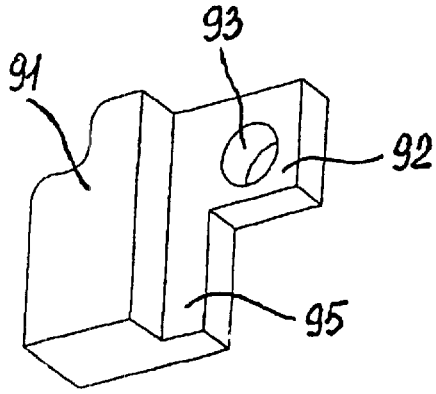
FIG. 28 is a general front view of the lock of the safety lock of the pistol.
Figure 29:
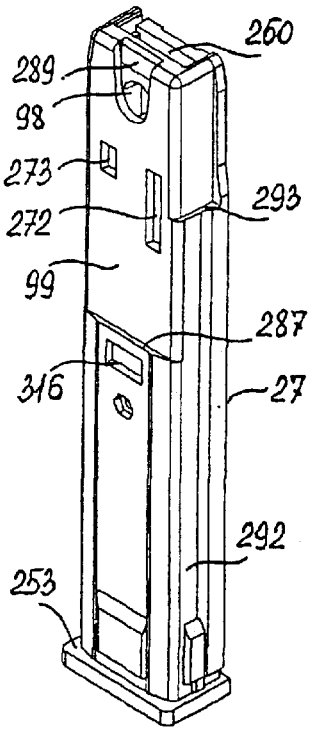
FIG. 29 is a general front view of the magazine of the pistol without a cover.
Figure 30:
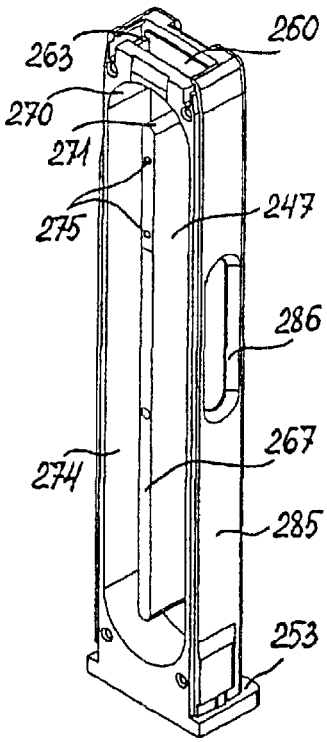
FIG. 30 is a general rear view of the magazine of the pistol.
Figure 32:
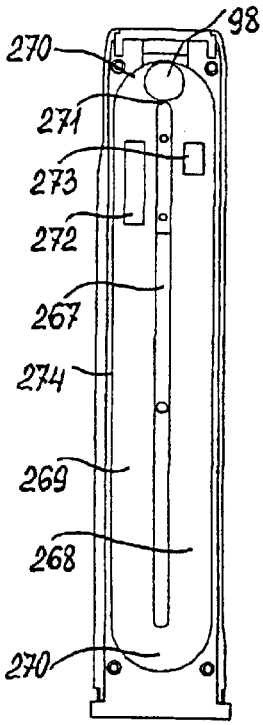
FIG. 32 is a rear elevation view of the magazine of the pistol without a cover.
Figure 31:
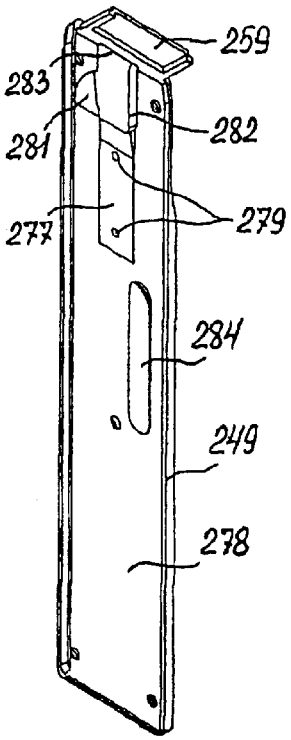
FIG. 31 is a general view of the interior of the magazine cover of the pistol.
Figure 33:
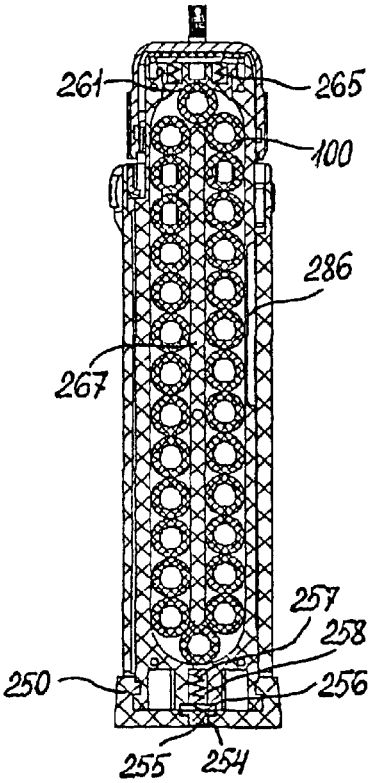
FIG. 33 is a rear sectional elevation view of the magazine of the pistol with a cover, a shoe and containers.

On the projection 80, on the side opposite the place where the recesses 82 and 83 are located, perpendicular to the axis of the cylinder 72, there is a groove 90. A lock 91 (FIG. 28) has an L-shaped projection 92, in the upper part of which there is an opening 93 located perpendicular to lateral sides of the lock 91. The L-shaped projection 92 is disposed in a groove 94 of the pistol frame 1, which is found between the partition 65 that separates the depression 58 adapted to receive the hammer 55 and the side wall of the pistol frame 1. A leg 95 of the projection 92 is inserted into the groove 90 and fixes the position of the safety lock 73 in the pistol frame 1. An opening 93 is disposed coaxially with the opening 61 in the hammer 55 and with the openings 62 in the lugs 63 and 64. In the opening 93 an axle of rotation 60 of the hammer 55 is also located for blocking the projection 92 of the lock 91 against dropping out from the groove 94.

Figure 34:
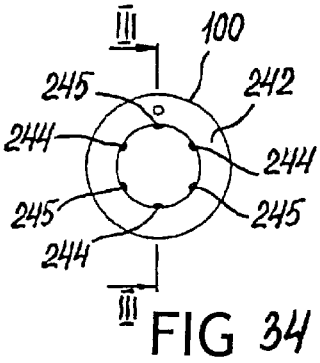
FIG. 34 is a top elevation view of a container.
Figure 35:
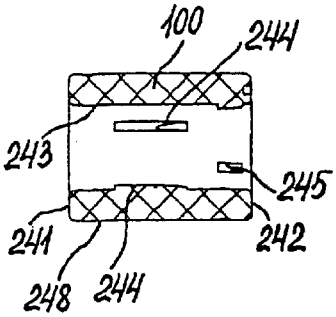
FIG. 35 is a section taken along III—III in FIG. 34.

A conical expansion 96 (FIG. 10) of a bullet bore 97 of the barrel 6 is disposed opposite a bullet opening 98 in a front wall 99 of the magazine 27 (FIGS. 29–33) and is coaxial with a container 100 (FIGS. 34, 35) and the valve 57.

Figure 36:
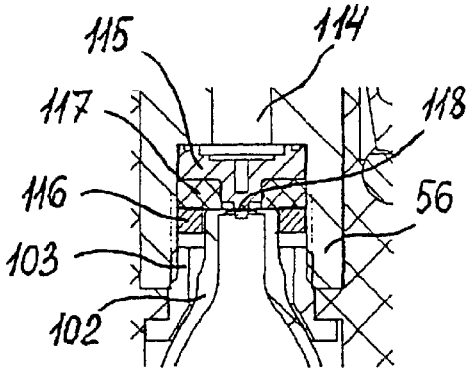
FIG. 36 is a sectional view of the place of junction of the gas cylinder with the piercing needle of the pistol.

The valve 57 is disposed in the body 56 installed in a depression 101 in a rear part of the pistol frame 1 above a gas cylinder 102 with the help of a threaded sleeve 103 which is inserted through a rear hollow interior 104 of the grip 3, and is screwed into a lower opening 105 of the body 56. The gas cylinder 102 is installed in the sleeve 103. The valve 57 is pressed by a spring 108 to an annular cup 106 disposed inside a saddle 107, the other end of the spring 108 abutting against a rear internal wall 109 of the body 56 of the valve 57. The spring 108 is found in a gas chamber 110 defined by the saddle 107 (FIG. 9) and the body 56 of the valve 57. To preclude gas leakage from the chamber 110, an annular seal 111 is provided between the body 56 and the saddle 107. This seal 111 is arranged in a groove 112 on the outer side of the saddle 107. From the side of the magazine 27 the valve 57 terminates with a hollow cylinder 113 which is located inside the saddle 107. The gas chamber 110 is communicated with a piercing needle 115 of the gas cylinder 102 via a conduit 114. Between the bearing side of the needle 115 and the gas cylinder 102 there are a nut 116, an end seal 117 and a filter 118 for filtering compressed gas from the gas cylinder 102 (FIG. 36).

Figure 37:
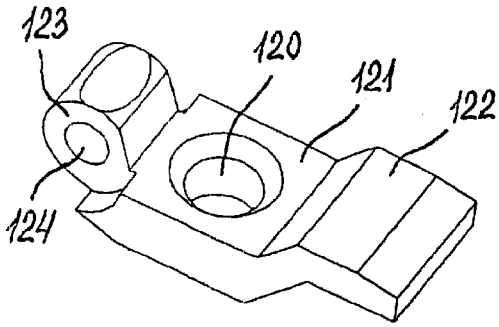
FIG. 37 is a general view of the loop of the pistol.
Figure 38:
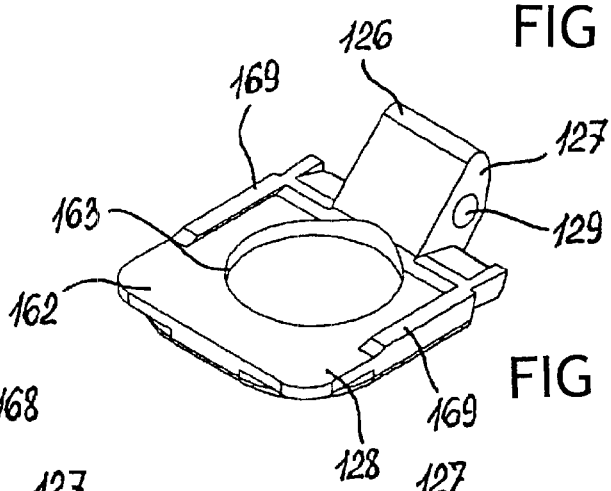
FIG. 38 is a general front view of the hold-down member of the pistol.
Figure 39:
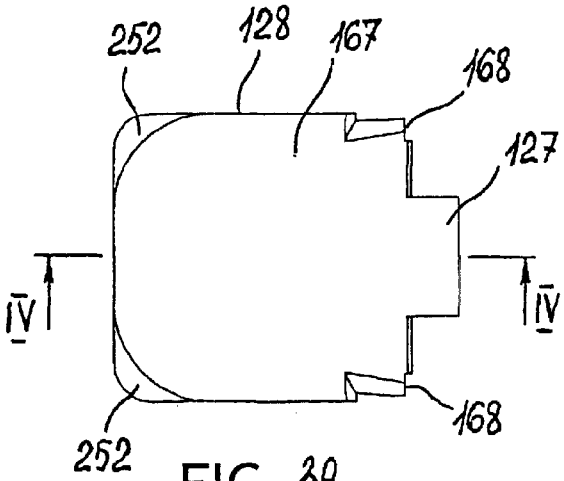
FIG. 39 is a bottom elevation view of the hold-down member of the pistol.
Figure 40:
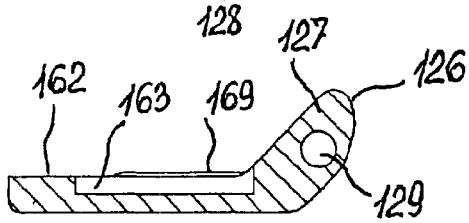
FIG. 40 is section taken along IV—IV in FIG. 39.
Figure 41:
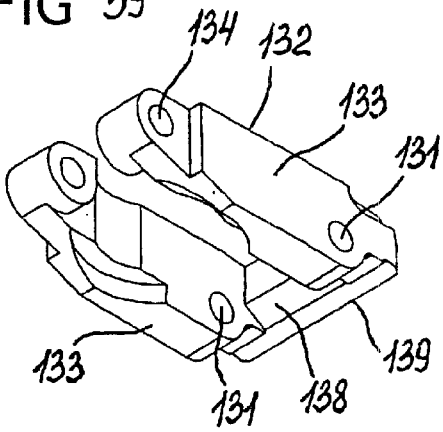
FIG. 41 is a general front view of the frame of the pistol.
Figure 42:
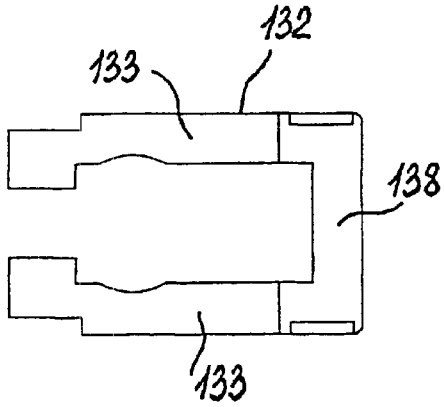
FIG. 42 is a top elevation view of the frame of the pistol.

The gas cylinder 102 is urged from below by a screw 119 which is screwed through a threaded opening 120 into a central part of a loop 121. The loop 121 (FIG. 37) has two shoulders which are lifted with respect to its central part: a shoulder 122 in the form of a horizontal platform and a cylindrical shoulder 123 with an opening 124 perpendicular to the screw 119. Through the opening 124 the loop 121 is mounted on a turning axle 125. The shoulder 122 is pressed by a profiled side 126 of a cam 127 of a hold-down member 128 (FIGS. 38–40). Owing to the provision of an opening 129, the hold-down member 128 is mounted on an axle of rotation 130 which is installed with its two ends in openings 131 of a frame 132. The frame 132 (FIGS. 41, 42) has two similar shoulders 133 arranged symmetrically near the loop 121. At the end of each shoulder 133 there is an opening 134, owing to which the frame 132, similarly to the loop 121, is mounted on the axle 125 whose ends are installed in openings 135 in side walls 136 in a front part of a bracket 137 (FIGS. 43, 44). A member 138 interconnecting the shoulders 133 of the frame 132 has a tooth 139 for interacting with a support 140 disposed from below the lower arm 141 of a lever 142 (FIG. 45). With the frame 132 in its closed position, the support 140 grips the tooth 139, precluding spontaneous opening of the rear space 104 and falling the gas cylinder 102 out of the grip 3.

The bracket 137 installed in the lower broadened part of the rear hollow interior 104 of the grip 3, owing to the provision of an opening 143 in the central part thereof and operating together with the hold-down member 128 and the screw 119, loop 121, frame 132 and lever 142 installed inside the bracket 137, insures stable position of the gas cylinder 102 in the grip 3. In the rear part of the bracket 137 there are openings 144 for installing an axle of rotation 145, on which, owing to an opening 146, the lever 142 is arranged. In the front upper and in the rear lower parts of the bracket 137 openings 147 are provided for installing pins 148 to fasten the bracket 137 to the grip 3. A front wall 149 of the bracket 137 is found just under a partition 150 separating the front hollow interior 151 of the grip 3, in which the magazine 27 is accommodated, from the rear hollow interior 104. In a rear wall 152 of the bracket 137 there is a groove 153 to receive the lever 142. In a wall 154 which defines the groove 153 from above, there is a depression 155 from the side of the groove 153, in which depression 155 a return spring 156 is installed, the other end of this spring being set onto a projection 157 in the upper part of the lower arm 141 of the lever 142. An upper arm 158 of the lever 142 has a lug 159 to fit the shooter's finger, this lug 159 coming to the surface of the grip 3 through an opening 160 in a rear wall 161 of the grip 3.

On an inner side 162 of the hold-down member 128 there is a depression 163 for accommodating a link 164 of the screw 119 serving to tighten the gas cylinder 102. The screw 119 and the link 164 are disposed on different sides of the loop 121.

On the rear lower parts of the side walls 136 of the bracket 137 there are lugs 165. From below on the lugs 165 platforms 166 are disposed, which insure installing the hold-down member 128 in its open position so that an external side 167 of the hold-down member 128 is positioned at a certain distance from the tooth 139 of the lower arm 141 of the lever 142 and does not affect it, whereas the platforms 166 of the lugs 165 adjoin angular supports 168 disposed on different sides of and symmetrically to the cam 127. In the closed state, the hold-down member 128 adjoins the platforms 166 of the bracket 137 with its edges 169 disposed behind the angular supports 168 along the edges on the inner side 162 of the hold-down member 128.

The trigger 36 (FIG. 17), owing to an opening 170 provided in the central part thereof, is mounted on an axle 171 installed in openings 172 provided in a lower middle part of side walls 173 of a through groove 174 of the support 5, and secured in the walls of the pistol frame 1. Externally on the side wall 173 of the groove 174 a cutout 175 is disposed to receive the projection 30 of the load 12. In a lower part of the trigger 36 a cocking arm 176 is located, in whose upper part two smaller arms 35 are arranged forkwise, which terminate with a radius part 41 and have openings 177 on their ends to dispose an axle 178 of the auto-sear 46. In the front part of the trigger 36 a decoupling projection 179 is located, which adjoins the inclined edge 52 of the projection 51 of the sear 39. In the rear part of the trigger 36 a larger L-shaped arm 180 is disposed, in whose lower part an opening 181 is provided for installing an axle of rotation 182 of a finger 183 (FIGS. 46, 47) and a limiter 184 (FIGS. 48, 49). In the upper part of the larger arm 180 of the trigger 36 an opening 185 is provided for a pressing spring to be hooked on, the other end of the pressing spring 186 being secured in an opening 187 provided in a smaller arm 188 of the auto-sear 46.

Next to the opening 187 in the auto-sear 46 (FIG. 20) an opening 189 is provided to locate the axle 178 on which the smaller arm 188 of the auto-sear 46 is secured between the smaller arms 35 of the trigger 36. From the top on a longer arm 190 of the auto-sear 46 a bolt camming lug 191 is located. The longer arm 190 terminates with a bevel 192 disposed at an acute angle to a bearing side 193 of the bolt camming lug 191. From the top on the auto-sear 46 between the bevel 192 and the bearing side 193 of the bolt camming lug 191 a bearing platform 194 is found. When the cocking arm 176 of the trigger 36 is pressed, the pressing spring 186 weakens, the longer arm 190 of the auto-sear 46 enters the groove 45 of the load 12. The bearing platform 194 and the bearing side 193 become pressed to a pin 195 installed in openings 196 that are provided in the front part of the bearing limiters 26 of the load 12, perpendicular to the auto-sear 46.

The trigger 36 is installed in the through groove 174 (FIG. 13) disposed in a middle part of the support 5 ahead of a vertically arranged through passage 197 for accommodating the sear 39. Between the grove 174 and the passage 197 a separating wall 198 is disposed, in the lower part of which a slit 199 is provided for accommodating the projection 51 of the sear 39. In front of the passage 197 atop of the support 5 a groove 200 is provided (FIG. 11) to receive the front part of the auto-sear 46, provided with the bevel 192. The width of the groove 200 is such that its side walls 201 do not allow the auto-sear 46 made in the form of a flat plate to leave the support 5. In the walls 201 of the front part of the groove 200 there are through openings 202 for locating a lowering member 203 made as a cylindrical pin. Under the upper front projection 9 in a base 204 of the support 5, parallel to the axis of the cylinder 11 there is a depression 205 to accommodate a rod 206. On one end of the rod 206 (FIG. 50) there is a cylindrical head 207 whose diameter is larger than the diameter of the rod 206. The head 207 functions as a detent when installing the rod 206 in the depression 205 of the support 5. On the rod 206 between the head 207 and a front wall 208 of the pistol breech block 2 under the breech block 2 a return spring 209 is disposed, which is in compressed state when the breech block 2 is installed on the pistol frame 1. The other end of the rod 206 is disposed in an opening 210 (FIG. 7) for preventing casual coming off of a return spring 209.

The finger 183 and the limiter 184 are disposed in the rear lower part of the support 5 in a depression 211 (FIG. 12) on different sides of the larger arm 180 of the trigger 36. From below the groove 174 constitutes a single space with a depression 211, which is separated from behind by a rear wall 212 of the support 5 from the front hollow interior 151 of the grip 3. In the upper part of the rear wall 212 there are two parallel rectangular openings: a large opening 213 for the finger 183 and a small opening 214 for the limiter 184.

The finger 183 has an inclined edge 215 adjoining a lower edge 216 of the opening 213 which limits the turn of the finger relative to the trigger 36. On an inner side 217 of the finger 183, nearest to the trigger 36, there is a lateral projection 218. When the inclined edge 215 ceases to adjoin the lower edge 216 of the opening 213, as the trigger 36 is pulled, the lateral projection 218 lies down on an inner side 219 of the wall 212 of the support 5. In the lower part of the finger 183 there is an opening 220 to receive the axle of rotation 182. In the middle part of the inclined edge 215 there is a step 221, next to which an opening 222 is provided to receive a bent end of the return spring (not shown in the Figures) of the finger 183. The place of junction of an upper edge 224 with the inclined edge 215 of the finger 183 terminates with a projection 225 rounded from above and having a vertically arranged platform 226 in the front part thereof.

The limiter 184 has an inclined edge 227 adjoining a lower edge 228 of the opening 214, which prevents turning of the limiter 184 relative to the trigger 36. On an inner side 229 of the limiter 184, proximate to the trigger 36, there is a lateral projection 230. When the inclined edge 227 ceases to adjoin the lower edge 228 of the opening 214, a lateral projection 230 lies down on the inner side 219 of the wall 212 of the support 5. In the lower part of the limiter 184 there is an opening 231 to accommodate the axle of rotation 182. In the middle part of the limiter 184, nearer to the inclined edge 227, there is an opening 232 to receive a bent end of a return spring 233 of the limiter 184. The place of junction of an upper edge 234 with the inclined edge 227 of the limiter 184 terminates with a projection 235 rounded from above.

The return spring of the finger 183 and the return spring 233 (FIG. 10) of the limiter 184 are secured with their second bent ends on a pin 236 installed in rear openings 237 disposed in the bottom part of side walls 238 in the rear part of the support 5.

As the trigger 36 is pulled, when the bearing side 193 of the bolt camming lug 191 of the auto-sear 46 ceases to adjoin the pin 195 under the action of the lowering member 203 on the bevel 192, the finger 183 and the limiter 184 turn through the same angle with respect to the trigger 36, so that the projection 225 of the finger 183, abutting against an upper edge 239 of the opening 213 of the support 5, and the projection 235 of the limiter 184, abutting against an upper edge 240 of the opening 214 of the support 5, move through these openings above the surface of the rear wall 212 of the support 5 and enter containers 100. The projection 225 of the finger 183 enters that of containers 100 which is being supplied to the shooting position, while the projection 235 of the limiter 184 enters an empty container 100 which is being withdrawn from said line after a shot has been made or during recharging.

Each container 100 (FIG. 35) is a hollow cylinder defined from the end faces by a barrel side 241 and a valve side 242. On an inner side 243 of the container 100 there are longitudinal projections 244 located near the barrel side 241 and tail projections 245 located near the valve side 242.

Each container 100 is loaded with one bullet 246. Bullets used in the pistol may be spherical, cylindrical or spindle-shaped, be made of metal or have a metal core or be made from a plastic or from a softer metal, e.g., from lead. The containers 100 are installed in an oval passage 247 inside the magazine 27 so that each container 100 touches with its outer cylindrical side 248 two other containers 100 disposed next to it on different sides thereof.

The magazine 27 shaped as a prism insures conveyer supply of bullets 246 to the shooting position and has a cover 249 (FIG. 31) which is rigidly secured to the magazine 27 by means of screws and a the same time is a rear wall of the magazine 27. With its front wall 99 the magazine 27 touches the rear wall 212 of the support 5, and with the cover 249 the magazine 27 touches the partition 150. Disposed on the magazine 27 from below is a shoe 250 which functions as a stop when the magazine 27 is installed into the front hollow interior 151 of the grip 3. On an internal side of the shoe 250 that faces the magazine 27 there are two platforms arranged symmetrically at the edges of the shoe 250, these platforms lying down onto lugs 252 of the hold-down member 128, located in the corners of its external side 167 facing the magazine 27, when the magazine 27 is installed in the grip 3, whereby the possibility of the hold-down member 128 to turn about the axle 130 is eliminated. In the shoe 250 secured on a base 253 of the magazine 27 there is an opening 254 whereinto a head 255 of a button 256 is received under the action of a spring 257 in a depression 258 from below of the base 253. The button 256 disposed in the base 253 prevents casual removal of the shoe 250 from the magazine 27. In its upper part the cover 249 has a horizontal shelf 259, under which a rectangular opening 260 is disposed, in which a block 261 is located. The block 261 (FIGS. 51, 52) has two lateral projections 262, owing to which it is installed on shelves 263 inside the magazine 27. From above in the block 261 depressions 264 are provided for springs 265 which bias the block 261 away from the horizontal shelf 259. From below, from the side of the oval passage 247, the block 261 has a concave wall 266 whose radius of rounding is equal to the radius of the cylindrical part of the container 100.

The oval passage 247 (FIG. 32) consists of two vertical straight parallel channels separated by a partition 267: a passage 268 for supplying the loaded container 100 for shooting and a passage 269 for removing the empty container 100 after shooting, interconnected from above and from below by semi-round passages 270. The width of the oval passage 247 is equal everywhere to the outer diameter of the cylindrical part of the container 100. The length of the oval passage 247 is such that the clearance between two neighboring containers 100 standing one next to another is always smaller than the width of the platform 226 of the finger 183. This prevents wedging by the finger 183 of the containers 100 standing one next to another and allows the containers 100 to move freely along the oval passage 247.

In the front wall 99 of the magazine 27 between the top of the upper semi-round passage 270 and an upper semi-round projection 271 of the partition 267 there is a bullet opening 98, whose diameter is larger than the diameter of the rear part of the expansion 96 of the barrel 6, but smaller than the outer diameter of the cylindrical part of the container 100. The rear part of the barrel 6, as it moves back to the valve 57, enters the opening 98. The container 100 is held from above opposite the opening 98 by means of the con-cave wall 266 of the block 261, and from below by the upper semi-round projection 271 of the partition 267. Below the opening 98 in the front wall 99 of the magazine 27 there are two openings 272 and 273, symmetrical to and equidistant from the partition 267 and the internal side walls 274 of the oval passage 247. The geometrical dimensions of the opening 272 for the finger 183 and of the opening 273 for the limiter 184 are exactly the same as of the openings 213 and 214, respectively, provided in the rear wall 212 of the support 5. As the magazine 27 is installed in the grip 3, the opening 272 is disposed precisely opposite the opening 213, and the opening 273 is disposed precisely opposite the opening 214.

In two depressions provided in the upper end part of the partition 267, from the side of the cover 249 of the magazine 27, two pins 275 are disposed, onto which a flat leaf spring 276 is fitted (FIG. 53) owing to the provision of two openings in its lower part. The leaf spring 276 is located in a rectangular depression 277 disposed on an inner side 278 of the cover 249. In the depression 277 there are two depressions 279 for installing the pins 275. In an upper part of the leaf spring 276 there is a throttle opening 280 disposed coaxially with the container 100 located before the shot in front of the leaf spring 276, and the hollow cylinder 113 of the valve 57, installed behind the leaf spring 276.

On an upper side 278 of the cover 249, above the place of junction of the passage 269 for removing the empty container 100 with the upper semi-round passage 270, there is disposed a semi-round depression 281 which eliminates jamming of the containers 100 as they move upon each pulling of the trigger 36.

In the upper part of the cover 249 there is a cutout 282 adapted to receive the front part of the hollow cylinder 113. The upper end of the flat leaf spring 276 lies on a bearing side 283 of the shelf 259 of the cover 249 of the magazine 27. Above one of the vertical passages 268 or 269 in the cover 249 there is an oblong opening 284 for loading the magazine 27 with the bullets 246. The width of the opening 284 is smaller than the external diameter of the container 100.

On a left side wall 285 of the magazine 27 there is an oblong opening 286, whose width is smaller than the longitudinal size of the container 100, for moving the containers 100 by the shooter's finger when loading the magazine 27.

On the front wall 99 of the magazine 27 a horizontal projection 287 is disposed, with which the magazine 27 abuts against a lower end face 288 of the rear wall 212 of the support 5 so that the bullet opening 98 in the front wall 99 is set opposite the conical expansion 96 of the barrel 6 coaxially therewith. Above the opening 98 there is a cutout 289 to receive a lug 290 disposed above the opening 8 in a rear wall 291 of the upper rear projection 10 of the support 5.

Figure 54:
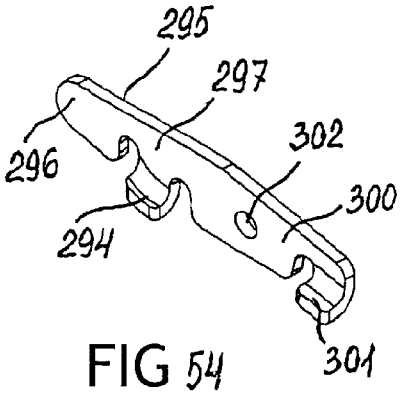
FIG. 54 is a general view of the rocker arm of the pistol.
Figure 56:
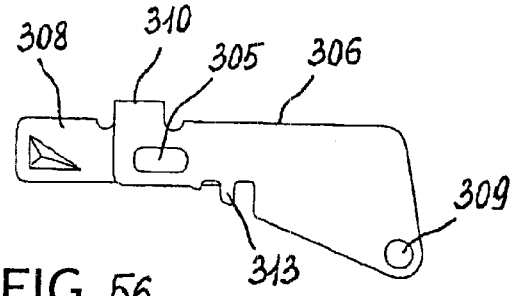
FIG. 56 is a left side elevation view of the slide stop of the pistol.
Figure 55:
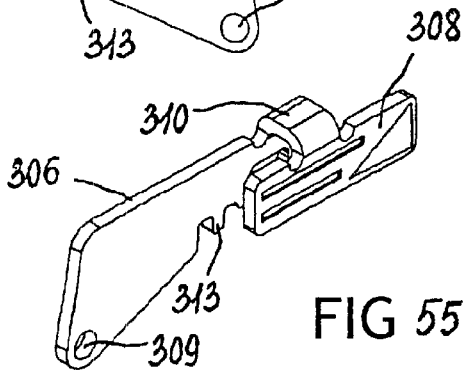
FIG. 55 is a general view of the slide stop of the pistol.

On a right side wall 292 of the magazine 27 there is a horizontal step 293 which supports a bend 294 of a rocker arm 295 (FIG. 54). An end part 296 of a long shoulder 297 of the rocker arm 295 is disposed in a groove 298 which is located between the wall of the pistol frame 1 and the wall of the depression 101 adapted to receive the housing 56 of the valve 57. On the end of a short shoulder 300 of the rocker arm 295 there is a carrier 301 bent away in the same direction as the bend 294. The rocker arm 295 is installed through an opening 302 provided in the short shoulder 300, on an axle secured in an opening 303 of the pistol frame 1, in a groove 304 of the pistol frame 1. The carrier 301 enters an opening 305 in a slide stop 306 (FIGS. 55, 56). The rocker arm 295 can rotate on an axle within the opening 305 till it abuts against the lower wall of the groove 298.

The slide stop 306 has a bent away button 308 and is mounted on the axle 171 of the trigger 36, through an opening 309 in the lower part of the slide stop 306. The axle 171, having passed through the support 5 and the trigger 36, is secured in the pistol frame 1. In its front part the slide stop 306 has an inflexion 310, below which the opening 305 is disposed, the inflexion 310 being located in a cutout 311 made in a wall 312 inside the breech block 2. From below, in the middle of the slide stop 306, there is a projection 313 onto which a spring is set (not shown in the Figures), whose other end is installed in a recess 315 disposed in the pistol frame 1 so that said spring presses the slide stop 306 to the breech block 2.

On the front wall 99 of the magazine 27 under the projection 287 there is a depression 316 in which a head 317 of a lock 318 of the magazine 27 is disposed.

Figure 57:
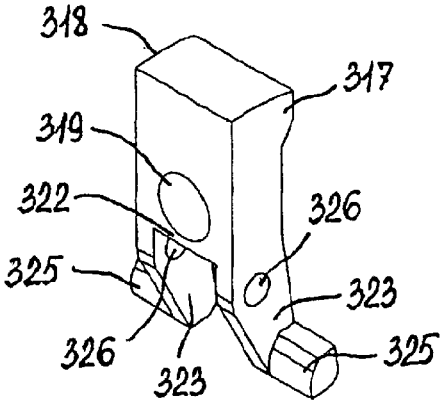
FIG. 57 is a general view of the lock of the pistol.

The lock 318 (FIG. 57) is made as a lever. In the upper part of the lock 318 from one side thereof the head 317 is located. In the middle of the lock 318 from the opposite side relative to the location of the head 317 there is a depression 319 in which a spring 320 is disposed, whose other end abuts against a projection 321 of the pistol frame 1. The lower part of the lock 318 is made as an unlocking fork 322 having two arms 323 with a lug 324 of the pistol frame 1 located therebetween. On the end of each arm 323 on the outer face thereof there is a projection 325 perpendicular to the lateral edge. In each arm there is an opening 326 into which an axle 327 is inserted, on which through an opening 328 the lug 324 of the pistol frame 1 is also received. The lug 324 smoothly passes into a narrowing 329 of the trigger bow 50 of the pistol frame 1.

In front of the opening 328 in the lug 324 an opening 330 is disposed for an axle 331 on which a latch 332 is arranged symmetrically to the narrowing 329 of the trigger bow 50.

Figure 58:
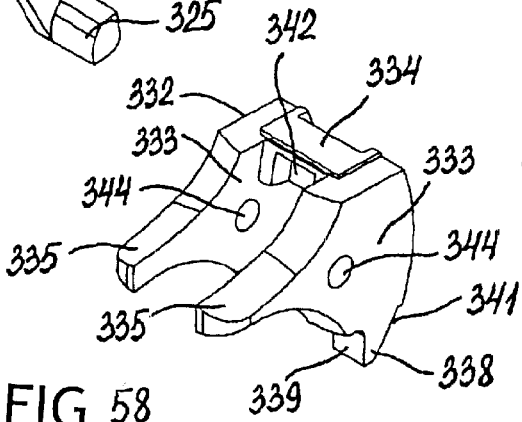
FIG. 58 is a general front view of the latch of the pistol.
Figure 59:
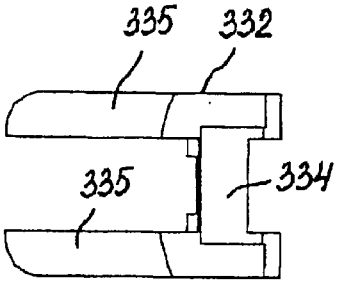
FIG. 59 is a top elevation view of the latch of the pistol.

The latch 332 (FIGS. 58, 59) consists of two flat cheeks 333 and a cross member 334 interconnecting their upper parts. The cheeks 333 have front projections 335 configured so that they cover from above the edges of sides 336 which constitute the narrowing 329 of the trigger bow 50 and close openings 337 arranged symmetrically on both sides of the pistol frame 1. The cheeks 333 are provided from below with lower projections 338 which with their edges 339 abut against the interior wall of the pistol frame 1 on both sides of the lug 324 and with rear inclined edges 341 abut against projections 325 of the unlocking fork 322 of the lock 318. In the cross member 334 from the side of configured front projections 335 there is a cutout 342 for a spring 343 of the latch 332. The axle 331 about which the latch 332 can turn when the ends of the projections 335 are pressed, is installed through openings 344 provided in the cheeks 333 in the opening 330 of the narrowing 329 on the trigger bow 50.

The latch 332 and the lock 318 insure stable retention of the magazine 27 in the grip 3 during shooting.

The support 5 is secured in the pistol frame 1 by means of a pin 346 installed through an opening 347 in the front projection 9 under the cylinder 11, in lugs 348 of the pistol frame 1 (FIG. 6), disposed on the opposite sides of the support 5; by means of a pin 349 installed in openings 350, directly above the latch 332 in the rear part of the support 5; by means of the axle 171 of the trigger 36, installed in the openings 172.

Installed from above on the pistol frame 1 is the breech block 2, under which the support 5 with the load 12, the barrel 6, the upper part of the magazine 27 and the upper part of the body 56 of the valve 57, the trigger bar 33, the hammer 55, and the lock 91 are located.

Above the opening 210 in the front wall 208 of the breech block 2 there is an opening 351 for the cylinder 11 of the support 5. Behind the breech block 2 there is a groove 352 for accommodating the head 67 of the hammer 55. The groove 352 is closed from the front by a strap 353.

On internal side walls 354 of the breech block 2 in the rear lower part thereof there are horizontal grooves 355 for receiving projections 356 located on side walls 357 of the body 56 of the valve 57. The length of the groove 355 is greater than the distance between a front wall 358 of the upper front projection 9 of the support 5 and an inner side 359 of the front wall 208 of the breech block 2. From below in the front part of the grooves 355 on the internal side walls 354 of the breech block 2 cutouts 360 are made, whose width is not smaller than the width of the projections 356 of the body 56 of the valve 57, through which the projections 356 enter the grooves 355.

Figure 60:
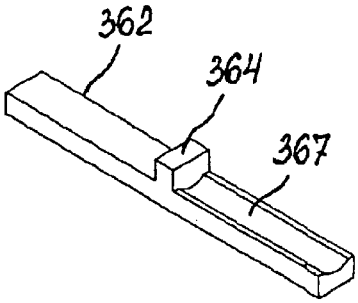
FIG. 60 is a general view of the stop of the pistol.
Figure 61:
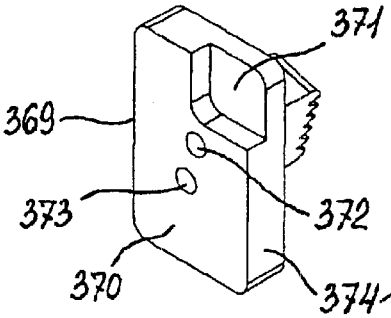
FIG. 61 is a general rear view of the button of the pistol.
Figure 62:
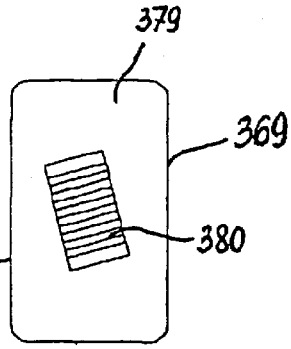
FIG. 62 is a front elevation view of the knob of the pistol.
Figure 63:
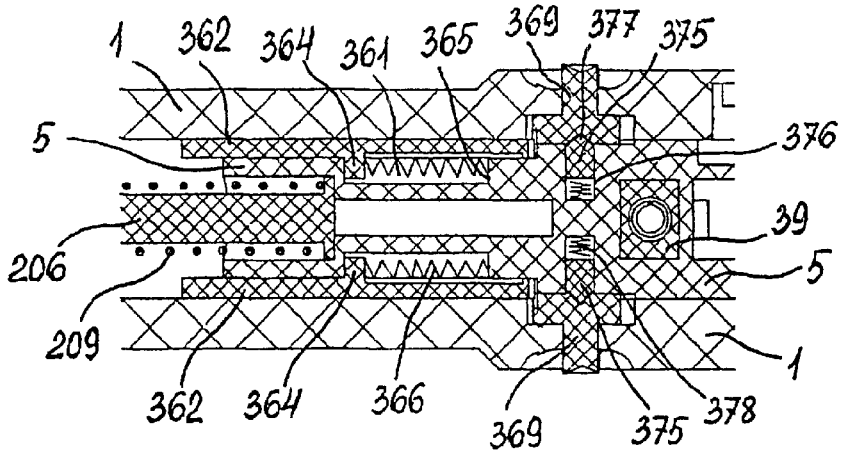
FIG. 63 is a fragment of a section taken along V—V in FIG. 1, showing the place where the stops and buttons of the pistol are located.

In the front part of the base 204 of the support 5 (FIG. 11), on both sides of the base 204, horizontal grooves 361 are disposed parallel to the direction of movement of the barrel 6 and serving to receive stops 362 (FIG. 60), one stop from each side. In the middle of each groove 361 there is a deeper groove 363 to accommodate in each of them a projection 364 of the stop 362. In the groove 363 between the projection 364 of the stop 362 and a rear wall 365 of the grove 363 a spring 366 is located. To limit dropping out of the spring 366, a longitudinal oval groove 367 is provided in the stop 362. On the side walls 173 of the support 5, perpendicular to each groove 361, an individual vertical groove 368 is provided for buttons 369 disposed therein to move therealong (FIGS. 61, 62). On an inner side 370 of each button 369, facing the support 5, in its upper corner facing the cylinder 11, there is a depression 371. Below the depression 371 there is a depression 372, under which a second depression 373 is located. When the button 369 is in its uppermost position, its recess 371 proves to be located higher than the groove 361, the stop 362 abuts against a lateral edge 374 and cannot move back to the grip 3. Each button 369 is fixed by its block 375 (FIG. 63) inserted in a depression 376 disposed in the lower part inside the groove 368. A conical head 377 of the block 375 enters the depression 373 under the pressure of its spring 378 acting on the block 375. The breech block 2 is blocked on the pistol frame 1, and casual jumping of the breech block 2 off the pistol frame 1 during the shooting is ruled out. When the button 369 is in its lowermost position, its depression 371 is disposed opposite the groove 361, so that the stop 362 can move back towards the grip 3. The conical head 377 of the block 375 enters the upper depression 372 and fixes the button 369. On an outer side 379 of each button 369 there is an individual pilot projection 380 which through its opening 381 in the pistol frame 1 extends above the lateral side thereof. With the button 369 in this position, the breech block 2 can be removed from the pistol frame 1.

Figure 64:
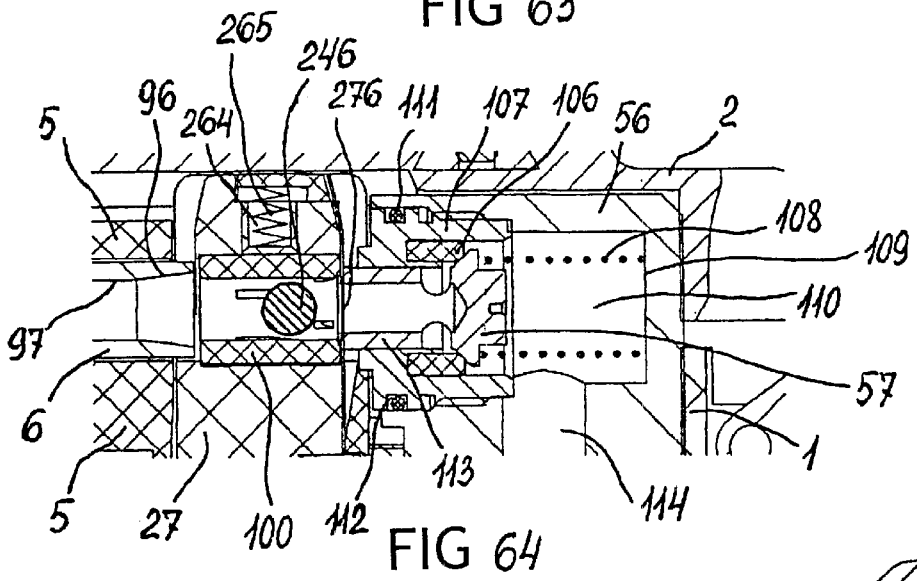
FIG. 64 is a fragment of a section taken along II—II in FIG. 2, showing the pistol in assembly, with the valve closed.

The pistol is prepared for shooting in the following manner. The gas cylinder 102 is inserted through the bracket 137 into the rear hollow interior 104 of the grip 3 and is closed from below with the frame 132, whose tooth 139 is gripped by the support 140 of the lever 142 and prevents the gas cylinder 102 from dropping out spontaneously from the grip 3. When the screw 119 is screwed in through the loop 121, the gas cylinder 102 is pressed through the sleeve 103 to the nut 116 and through the end seal 117 to the piercing needle 115 of the gas cylinder 102. The gas cylinder 102 is pierced by the needle 115 after the hold-down member 128 turns on the axle 130. The hold-down member 128 closes from below the frame 132 and the loop 121 with the screw 119. After the gas cylinder 102 has been punctured by the needle 115, gas through the filter 118 and the passage 114 in the body 56 comes to the gas chamber 10 provided in the body 56 of the valve 57. After that the loaded magazine 27 is installed into the front hollow interior 151 of the grip 3 in such a manner that the platforms of the shoe 250 lie down onto the lugs 252 of the hold-down member 128. Spontaneous opening of the hold-down member 128 is prevented by the moment of the gas pressure force, transmitted to the cam 127 through the loop 121. The magazine 27 is installed so that the bullet opening 98 is disposed coaxially with the barrel 6 and the valve 57, with the help of the lock 318, whose head 317 is sunk in the depression 316 in the front wall 99 of the magazine 27. The valve 57 is closed (FIG. 64).

Loading of the magazine 27 is carried out as follows. Each bullet 246 through the opening 284 in the cover 249 is loaded into its container 100 from its valve side 242 by depressing the bullet 246 with the shooter's finger, whereby the bullet becomes installed between the longitudinal projections 244 and the tail projections 245, and it cannot jump spontaneously from the container 100. After all the containers 100 disposed opposite the opening 284 have been loaded, the shooter moves with his finger the containers through the opening 286 in the left wall 285 of the magazine 27 along the oval passage 247 and installs a next group of containers 100 opposite the opening 284 for loading. This procedure is repeated till the magazine 27 is fully loaded with the bullets 246.

The safety lock 73 is brought to its topmost position, whereby free turning of the hammer 55 is insured.

Figure 65:
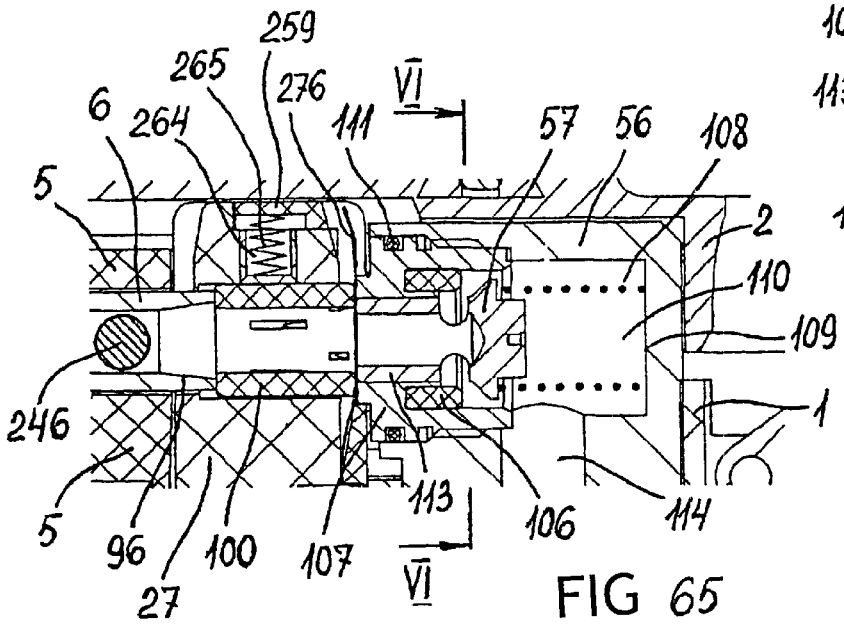
FIG. 65 is a fragment of a section taken along II—II in FIG. 2, showing the pistol in assembly, with the valve open.
Figure 66:
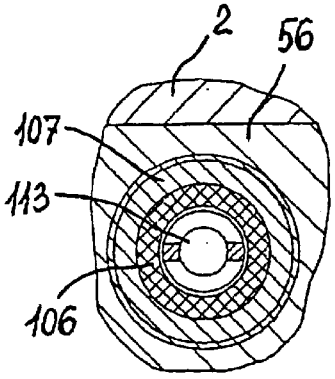
FIG. 66 is a fragment of a section taken along VI—VI in FIG. 64, with the valve open.

Shooting from the pistol, e.g., by self-cocking, is performed as follows. When the cocking arm 176 is pressed, the larger arm 180 of the trigger 36 lifts the finger 183 and the limiter 184. The projection 225 of the finger 183 enters the container 100 with the bullet 246, supplied to the shooting position, and the projection 235 of the limiter 184 enters, with some delay relative to the moment of the projection 225 entering the container 100, another empty container 100 being removed from the shooting position. Simultaneously, under the action of the small arm 35 of the trigger 36, which is coupled by the axle 178 to the smaller arm 188 of the auto-sear 46, the auto-sear 46, moving forward, urges the pin 195 installed in the load 12 by the bearing side 193 of the camming lug 191. The load 12 which is rigidly secured to the barrel 6 with the help of pins 15, together with the barrel 6 and the trigger bar 33, also rigidly connected to the load 12, move forward, the mainspring 19 contracts, the buffer spring 24 extends, and the hammer 55, owing to the pivot 54 located in the opening 53 of the trigger bar 33, becomes cocked. As the trigger 36 turns further on the axle 171, the auto-sear 46 interacts by its bevel 192 with the lowering member 203. The bearing side 193 of the auto-sear 46 comes out of engagement with the pin 195 of the load 12 under the action of the lowering member 203. At the same time, the pin 183 and the limiter 184 abut against the upper edge 239 of the opening 213 and against the upper edge 240 of the opening 214 on the support 5, respectively, so that the container 100 becomes arranged coaxially with the barrel 6 and the cylinder 113 of the valve 57, and is fixed by the block 261 with the help of the concave wall 266 and the upper semi-round projection 271. At the same time, the decoupling projection 179 of the trigger 36 lowers the sear 39 by acting upon its inclined edge 52. The load 12 gets loose from the auto-sear 46, and under the action of the mainspring 19 the load 12 with the barrel 6 moves back to the container 100 and the valve 57. The buffer spring 24 contracts, and the barrel 6 strikes with the end face of the conical expansion 96 the barrel side 241 of the of the container 100, which, moving back to the valve 57, strikes with its valve side 242 the cylinder 113 of the valve 57. The barrel 6 with the load 12, the container 100 via the flexible leaf spring 276, and the valve 57 move back to the body 56 of the valve 57. The valve 57 opens (FIGS. 65, 66), the spring 108 of the valve 57 contracts, and gas from the gas chamber 110 through the valve 57 comes to the cylinder 113 of the valve 57 and further to the container 100, pushing the bullet 246 out into the barrel 6. A shot occurs. Then, under the action of the buffer spring 24, the load 12 with the barrel 6 takes up such position that the rear part of the barrel 6 comes out from the bullet opening 98 in the front wall 99 of the magazine 27 and stops at a certain distance from the front wall 99 so that it does not interfere with the free movement of the magazine 27 as it is removed from the front hollow interior 151 of the grip 3. The leaf spring 276 straightens and returns the container 100 inside the semi-round passage 270.

Shooting from the pistol, e.g., with pre-cocking the hammer 55, performed in the following manner. When the head 67 is pressed, the hammer 55 with the lateral shoulder 69 via the pivot 54 disposed in the opening 53 of the trigger bar 33 moves the trigger bar 33 forward. The front opening 32 is set onto to pivot 31 of the load 12 so that the action is transmitted to the projection 30 of the load 12, the load 12 with the barrel 6 moves forward to the upper front projection 9 of the support 4. The mainspring 19 contracts, and the buffer spring 24 extends. The wall 40 of the groove 34 of the load 12 acts on the radius part 41 of the smaller arm 35 of the trigger 36 so, that the trigger 36 turns on the axle 171. The finger 183 and the limiter 184 move to their openings 213 and 214, as described above for the mechanism operation in the case of self-cocking.

When the finger 183 abuts against the upper edge 239, and the limiter 184 abuts against the upper edge 240, the auto-sear 46 is disposed in such a manner that its bearing side 193 does not interact with the pin 195 and the bevel 192 under the action of the pressing spring 186 abuts against the lowering member 203. The decoupling projection 179 of the trigger 36, acting on the inclined edge 52 of the sear 39, retains the sear 39 by compressing the spring 49 so that the shoulders 38 of the sear 39 do not interact with the projection 37 of the load 12.

Cocking of the hammer 55 can be effected as the breech block 2 moves to the rearmost position for reloading the magazine 27 under the action of the strap 353 of the breech block 2 on the hammer 55. The stops 362 abut against the lateral edges 374 of the buttons 369 and do not allow the cutouts 360 of the grooves 355 to jump off the projections 356 of the body 56 of the valve 57.

When the buttons 369 are disposed below so that the depression 371 is found opposite the stop 362 and does not interfere with its further travel back under the action of the front wall 208 of the breech block 2, the breech block 2 can be removed from the projections 356 of the body 56 of the valve 57, when the return spring 209 of the breech block 2 is compressed maximally.

The slide stop 306 is pressed to the breech block 2, and when the cutout 311 of the breech block 2 is above the inflexion 310 of the slide stop 306, the inflexion 310 jumps into the recess 311 under the action of the spring, the breech block 2 in this case is in the rear position, and the finger 183 and the limiter 184 enter the containers 100 supplied to and removed from the shooting position, respectively. The magazine 27 with the lock 318 being pushed away cannot be removed from the front hollow interior 151 of the grip 3.

When the bent away button 308 of the slide stop 306 is pressed, the inflexion 310 leaves the cutout 311 of the breech block 2, the breech block 2 under the action of the return spring 209 disposed on the rod 206 returns to the extreme front position. The strap 353 abuts against the body 56. The head 67 of the hammer 55 comes out of engagement with the strap 353.

Under the action of the mainspring 19, the load 12 with the barrel 6 moves back so that the radius part 41 of the smaller arm 35 of the trigger 36, pressed by the return springs of the finger 183 and of the limiter 184 to the wall 40 of the groove 34 of the load 12, moves the trigger 36 backward so that the decoupling projection 179 also turns back, and the sear 39 under the action of the extending spring 49 rises to the load 12, the shoulders 38 of the sear 39 rise across the path of travel of the load 12, abutting against the projection 37 of the groove 34 of the load 12, and block the travel of the load 12 with the barrel 6 back to the magazine 27 with the container 100 found in the shooting position. The mainspring 19 is compressed, the buffer spring 24 is in its extended state, and the bearing side 193 of the auto-sear 46 lies below the pin 195, as described above. The pistol is ready for shooting with pre-cocking of the hammer 55. For making a shot, it is necessary to press the cocking arm 176 of the trigger 36. The trigger 36 will turn on the axle 171, and the radius part 41 of the smaller shoulder 35 of the trigger 36 will move away from the wall 40 of the load 12. At the same time, the pin 183 and the limiter 184 will abut with their rounded projections 225 and 235, respectively, against the internal sides of the containers 100 being supplied to and removed from the shooting position, and will fix their position. The decoupling projection 179 of the trigger 36, acting on the projection 51 of the sear 39, will bring the sear 39 down, the spring 49 in the sear 39 will be compressed, and the shoulders 38 of the sear 39 will come out of engagement with the projection 37 of the groove 34 of the load 12. The load 12 with the barrel 6, under the action of the mainspring 19 will strike energetically the container 100 which is in the shooting position in the magazine 27 opposite the bullet opening 98, compressing while doing so the buffer spring 24. The container 100 will strike the cylinder 113 of the valve 57. The valve 57 will open, and a portion of gas from the gas chamber 110 of the body 56 of the valve 57 will enter the space behind the bullet 246 and will push the bullet 246 from the container 100 into the bullet bore 97 of the barrel 6.

A shot will take place, after which the mechanism will be ready for repeated shooting either after pre-cocking the hammer 55 by the shooter's hand or under the action of the retracted breech block 2.

INDUSTRIAL APPLICABILITY

The pistol of the invention can be easily manufactured from the contemporary materials by using the existing technology and may be employed most effectively in the production of repeating gas cylinder firearms shooting spherical cylindrical or spindle-shaped iron bullets, iron-core bullets, or bullets made from plastics or a softer metal, e.g., lead.

What is claimed is:

1. A repeating gas cylinder pistol, comprising a hollow pistol frame (1) made integral with a grip (3) and a trigger bow (50), a movable barrel (6) with a bullet bore (97), a load (12) and a mainspring (19) disposed on the barrel (6), a valve (57) installed in a gas chamber (110) inside a body (56), between a rear inner wall (109) of which and the valve (57) a spring (108) is installed, which insures returning of the valve (57) to the closed state after a portion of gas has come from the gas chamber (110) to the bullet bore (97) of the barrel (6), the body (56) of the valve (57) whose lower part is disposed in a depression (101) in a rear part of the pistol frame (1) above a gas cylinder (102) which is installed in a rear hollow interior (104) of the grip (3) and via a sleeve (103), a nut (116) and an end seal (117) is communicated with the body (56) of the valve (57), and via a piercing needle (115), a filter (118) and a passage (114) in the body (56) insures coming of a portion of gas to the gas chamber (110), a magazine (27) installed in a front hollow interior (151) separated from the rear hollow interior (104) of the grip (3) by a partition (150), a striker-and-trigger mechanism installed inside the pistol frame (1) and on the trigger bow (50) and interacting with the movable barrel (6) and the magazine (27) for supplying bullets (246) and portions of gas from the gas cylinder (102) to the bullet bore (97) of the barrel (6), a mechanism for installing the gas cylinder (102), disposed below the gas cylinder (102) in a lower broadened part of the rear hollow interior (104) of the grip (3), characterized in that in a rear hollow interior (4) of the pistol frame (1) a support (5) is located, whose rear wall (212) adjoins a front wall (99) of the magazine (27), a part of the support (5) extending above the pistol frame (1) serves to carry the barrel (6) movable along the support (5) under the action of the striker-and-trigger mechanism, the magazine (27) insures conveyer supply of the bullets (246) to the shooting position and is equipped with containers (100), each container (100) accommodates one bullet (246) and is installed so that the upper part of the magazine (27), extending above the pistol frame (1), is disposed between the barrel (6) and the valve (57), and a bullet opening (98) provided in a front wall (99) of the magazine (27), through which the bullet (246) enters the bullet bore (97) of the barrel (6) under the effect of a portion of gas, is disposed coaxially with the bullet bore (97), the valve (57) and the container (100) which occupies such position before each shot, a breech block (2) is installed on top of the hollow pistol frame (1).

2. The pistol of claim 1, characterized in that the mechanism for installing the gas cylinder (102) comprises a bracket (137) installed with the help of pins (148) in the lower broadened part of the rear hollow interior (104) of the grip (3), a front wall (149) being disposed under a partition (150) and adjoining the magazine (27), the surface of the wall (149) lying in one plane with the surface of the partition (150) adjoining the magazine (27); a lever (142) installed in the rear part of the bracket (137) on an axle of rotation (145), a frame (132) and a loop (121) mounted on a turning axle (125) in a front part of the bracket (137) more proximate to the magazine (27), a hold-down member (128) mounted on an axle of rotation (130) on the frame (132) on the side opposite the place of fastening the frame (132) to the bracket (137), a tightening screw (119) located in the central part of the loop (121).

3. The pistol of claim 2, characterized in that the tightening screw (119) has a link (164) with which the screw (119) abuts against the bottom part of the gas cylinder (102) when the frame (132) is in the closed position, and which, as the screw (119) is screwed into the loop (121) through an opening (120), urges the gas cylinder (102) till it is pressed to the piercing needle (115) of the gas cylinder (102).

4. The pistol of claim 2, characterized in that the bracket (137) has in the central part an opening (143) through which the gas cylinder (102) is installed in the rear hollow interior (104) of the grip (3), when the frame (132) is in the open position, a groove (153) disposed in a rear wall (152) and combined with the opening (143), in which groove (153) the lever (142) is disposed, there being provided a horizontal wall (154) above the part of the groove (153) which is nearer to a rear wall (161) of the grip (3), in which horizontal wall (154) from the side of the groove (153) there is a depression (155), and side walls (136) which have horizontal platforms (166) disposed from below and lugs (165) disposed from the side of the groove (153) and abutting against supports provided on the inner side walls of the grip (3).

5. The pistol of claim 2, characterized in that the frame (132) has two shoulders (133) between which the loop (121) is located, the shoulders (133) being interconnected from one side by a member (138) which is provided with a tooth (139) which abuts against a support (140) of the lever (142) when the frame (132) is in the closed position.

6. The pistol of claim 2, characterized in that the lever (142) has an upper arm (158) on the end of which a lug (159) is located from above, which lug (159) trough an opening (160) in a rear wall (161) is disposed on the level of the surface of the grip (3); a lower arm (141) on the end of which a support (140) is located from below and a projection (157) is located from above, onto which projection (157) a return spring (156) is set, the return spring (156) abutting with its other end against a depression (155) in the bracket (137), the return spring (156), when extended, retaining, owing to the support (140) which grips the tooth (139), the frame (132) in the closed position, and, with the return spring (156) contracted, when under the pressure of the shooter's finger on the lug (159) the lever (142) turns on the axle (125), releasing the tooth (139) from the support (140), the frame (132) assumes its open position.

7. The pistol of claim 2, characterized in that the loop (121) has shoulders which are lifted with respect to its central part towards the frame (132): a shoulder (122) in the form of a horizontal platform and a cylindrical shoulder (123) with an opening (124) which is perpendicular to the axis of the screw (119) and in which the turning axle (125) is disposed.

8. The pistol of claim 2, characterized in that the hold-down member (128) which closes from below the frame (132) with the loop (121) and the screw (119) has a cam (127) which extends above the flat part of the hold-down member (128), is mounted through the opening (129) on the axle of rotation (130) on the frame (132) between its shoulders (133), and presses with its profiled side (126) the shoulder (122) of the loop (121) when the hold-down member (128) is in the closed position, a depression (163) on the inner side (162) to receive the link (164) of the screw (119), angular supports (168) disposed from the side of and symmetrically to the cam (127) and, adjoining the platforms (166) of the lugs (165), insures stopping the hold-down member (128) in the open position; when an external side (167) of the hold-down member (128) is found at a certain distance from the tooth (139) of the lower arm (141) of the lever (142) and does not affect it; edges (169) disposed behind angular supports (168) along the edges of the inner side (162) of the hold-down member (128) and adjoining the platforms (166) of the bracket (137) when the hold-down member (128) is in the closed position; lugs (252) located in the corners on the external side (167) of the hold-down member (128), facing the magazine (27).

9. The pistol of claim 1, characterized in that the load (12) via a through longitudinal opening (13) provided therein is set onto the barrel (6) and is secured by pins (15) through openings (14) to the barrel (6) owing to depressions (16) disposed on the barrel (6) perpendicular to the axis thereof, in which the pins (15) are partially received; in front of the longitudinal opening (13) in the load (12) a cylindrical recess (17) is disposed; behind the longitudinal opening (13) there is a rear space (22), from below along the edges of the load (12) two longitudinal support limiters (26) are disposed, movable along the support (5) as the barrel (6) moves longitudinally; from below on one of the limiters (26) a projection (30) is disposed with a pivot (31); between the limiters (26) under the longitudinal opening (13) which is separated by a partition (42) there is a groove (34) defined from the front by a projection (37) and from the rear by an inclined wall (40), on whose end opposite the projection (30) with the pivot (31) there is a cutout (43); from below in the cylindrical recess (17) in front of the projection (37) a through groove (45) is disposed.

10. A pistol of claim 9, characterized in that in the front part of the through groove (45) perpendicular to the direction of travel of the load (12) a pin (195) is disposed, adapted to interact with an auto-sear (46) and secured on the load (12) through openings (196) disposed in the support limiters (26).

11. The pistol of claim 1, characterized in that the magazine (27) made in the form of a prism has a flat cover (249) which is rigidly secured to the magazine (27) and at the same time is a rear wall of the magazine (27), which adjoins a partition (150) in the grip (3); the magazine (27) is closed from above by a horizontal shelf (259) disposed in the upper part of the cover (249) perpendicular to the surface thereof; the magazine (27) is limited from below by a base (253); the magazine (27) is provided with an oval passage (247) to accommodate the containers (100) with the bullets (246).

12. The pistol of claim 11, characterized in that onto the base (253) of the magazine (27) a shoe (250) is set, on whose inner side facing the base (253) there are two platforms disposed symmetrically at the edges thereof, which platforms lie down onto the lugs (252) of the hold-down member (128) and serve as a stop for the magazine (27) after installing thereof in the grip (3).

13. The pistol of claim 12, characterized in that the shoe (250) has an opening (254) whereinto a head (255) of a button (256) is received under the pressure of a spring (257) installed in a depression (258) from below of the base (253) of the magazine (27).

14. The pistol of claim 11, characterized in that the oval passage (247) along which the containers (100) move comprises two vertical, straight, parallel passages separated by a partition (267), a passage (268) for supplying the container (100) loaded with the bullet (246) for shooting and a passage (269) for removing the empty container (100) after shooting, interconnected from above and from below by semi-round passages (270).

15. The pistol of claim 14, characterized in that the width of the oval passage (247) is equal to the outer diameter of the cylindrical part of the container (100) and the length is such that the clearance between two containers (100) standing one next to another is always smaller than the width of the platform (226) of the finger (183) for the containers to move freely along the oval passage (247).

16. The pistol of claim 11, characterized in that in the upper part of the magazine (27) under the horizontal shelf (259) there is an opening (260) in which a block (261) is disposed, whose two lateral projections (262) rest on the side shelves (263) disposed inside an opening (260).

17. The pistol of claim 16, characterized in that from above in the block (261) depressions (264) are provided for springs (265) which bias the block (261) away from the horizontal shelf (259) of the cover (249).

18. The pistol of claim 16, characterized in that from the side of the oval passage (247) a wall (266) of the block (261) is concave, its radius of rounding being equal to the outer radius of the cylindrical part of the container (100) for stable location of the container (100) before the shot opposite the bullet opening (98) in the front wall (99) of the magazine (27) coaxially with the valve (57) and the bullet bore (97).

19. The pistol of claim 11, characterized in that on an inner side (278) of the upper part of the cover (249) in a depression (277) a part of a flat leaf spring (276) is disposed, which through openings therein is secured by pins (275) installed in the end face part of the partition (267) and in depressions (279) of the cover (249), the other part of the leaf spring (276) being located in a cutout (282) disposed in the cover (249) under the depression (277), the upper end of the leaf spring (276) lying on a bearing side (283) of the horizontal shelf (259).

20. The pistol of claim 11, characterized in that on the inner side (278) of the upper part of the cover (249) above the place of junction of the passage (269) for removing the empty container (100) with the upper semi-round passage (270), there is disposed a semi-round depression (281) which eliminates jamming of the containers (100).

21. The pistol of claim 11, characterized in that the container (100) is a hollow cylinder having a barrel side (241) disposed from the side of the barrel (6) after locating the container (100) in the magazine (27), and a valve side (242) adjoining the inner side (278) of the cover (249) of the magazine (27), and face sides; on the inner side (243) of the container (100) longitudinal recesses (244) are disposed and tail projections (245), located nearer to the valve side (242), which insure retention of the bullet (246) inside the container (100) after loading thereof.

22. The pistol of claim 21, characterized in that the bullets (246) used for loading into the container (100) are spherical or cylindrical or spindle-shaped.

23. The pistol of claim 21, characterized in that the bullets (246) used for loading into the container (100) are made from iron or have an iron tip, or are made from a softer metal or plastic.

24. The pistol of claim 11, characterized in that above the oval passage (247) in the cover (249) of the magazine (27) for loading the containers (100) with the bullets (246) an opening (284) is provided, whose width is smaller than the external diameter of the cylindrical part of the container (100), but larger than the diameter of the bullet (246).

25. The pistol of claim 11, characterized in that on the right side wall (292) of the magazine (27) there is a step (293) which supports a bend (294) of a rocker arm (295).

26. The pistol of claim 11, characterized in that on the left side wall (292) of the magazine (27) there is an oblong opening (286) whose width is smaller than the longitudinal size of the container (100), for moving the containers (100) by the shooter's finger when loading the magazine (27).

27. The pistol of claim 11, characterized in that on the front wall (99) of the magazine (27) a horizontal projection (287) is disposed, with which the magazine (27) abuts against a lower end face (288) of the rear wall (212) of the support (5) when installing said magazine (27) in the grip (3); under the projection (287) there is a depression (316) for locating a head (317) of a lock (318) of the magazine (27); above the projection (287) in the front wall (99) there is a large opening (272) for the finger (183) above the passage (268) for supplying the container (100) to the shooting position and a small opening (273) for the limiter (184) above the passage (269) for removing the empty container (100) from the shooting position; above the bullet opening (98) a cutout (289) is provided to receive a lug (290), disposed above the opening (8) in the rear wall (291) of the upper rear projection (10) of the support (5).

28. The pistol of claim 27, characterized in that the size and shape of the large opening (272) and of the small opening (273) coincide, respectively, with the opening (213) for the finger (183) and with the opening (214) for the limiter (184), provided in the rear wall (212) of the support (5), and are also disposed, respectively, one opposite the other after installing the magazine (27) in the grip (3).

29. The pistol of claim 1, characterized in that in the upper part of the body (56) of the valve (57) opposite the magazine (27) a ring-shaped saddle (107) is provided, inside which a hollow cylinder (113) of the valve (57) is located, the end face part of the cylinder (113) enters the cutout (282) in the upper part of the cover (249) of the magazine (27) and abuts against the flat leaf spring (276) which limits from the front the travel of the valve (57) with the cylinder (113), the valve (57) installed coaxially with the bullet bore (97) of the barrel (6) and with a throttle opening (280) in the leaf spring (276) being in the closed state, when the spring (108) is extended and the valve (57) is pressed to the saddle (107) or making up a clearance with the saddle (107), when after a short-time action of the leaf spring (276) on the cylinder (113) of the valve (57) the spring (108) is compressed, for a portion of gas to come from the gas chamber (110) to the cylinder (113) of the valve (57).

30. The pistol of claim 29, characterized in that between the saddle (107) and the valve (57) an annular cup (106) is disposed, which precludes coming of a portion of gas to the cylinder (113) when the valve (57) is closed.

31. The pistol of claim 29, characterized in that between the body (56) of the valve (57) and the saddle (107) in an annular groove (112) provided on the side of the saddle (107) which adjoins the body (56) a seal (111) is disposed, which precludes gas leakage from the gas chamber (110).

32. The pistol of claim 1, characterized in that the support (5) has a base (204) arranged in the hollow interior (4) of the pistol frame (1); from above the base (204), above the pistol frame (1) there are disposed a rear projection (10) next to the magazine (27) and a front projection (9) with a hollow cylinder (11) disposed ahead of it; in the middle part of the base (204) of the support (5) a through vertical passage (197) is located for accommodating a sear (39); in front in the base (204) there is a depression (205) for a rod (206); from above the base (204), between the depression (205) for the rod (206) and the through passage (197), there is a groove (200) for an auto-sear (46); on the other side of the through passage (197) in the base (5) there is a through longitudinal groove (174) for a trigger (36), the through longitudinal grove (174) being combined with a depression (211) disposed under the rear projection (10) and in which a larger arm (180) of the trigger (36), the finger (183) and the limiter (184) are located, disposed on different sides relative to the larger arm (180) of the trigger (36); in the rear wall (212) of the support (5) there are a large opening (213) for the finger (183) and a small opening (214) for the limiter (184).

33. The pistol of claim 32, characterized in that in the groove (200) for the auto-sear (46), a lowering member (203) made as a pin secured in the side walls of the base (204) of the support (5) is disposed perpendicular to the direction of movement of the barrel (6).

34. The pistol of claim 32, characterized in that the end face part of the hollow cylinder (11) extends above a front wall (208) of the breech block (2) through an opening (351).

35. The pistol of claim 32, characterized in that in the front projection (9) with the cylinder (11) and in the rear projection (10) openings (7) and (8) are disposed, respectively, through which the barrel (6) is installed in the support (5) so that the load (12) secured on the barrel (6) is found behind the front projection (9), and in a rear space (22) of the load (12) the rear projection (10) of the support (5) is disposed, the openings (7) and (8) in the projections (9) and (10), respectively, serving as pilot holes when the barrel (6) moves relative to the support (5).

36. The pistol of claim 32, characterized in that in the lower part of the rear projection (10) from the side of the load (12) there is a step (29) for cutouts (28) provided on support limiters (26) of the load (12), the step (29) fixing the rearmost position of the barrel (6) when it moves toward the magazine (27).

37. The pistol of claim 32, characterized in that from the outside on the right side wall (173) of the through groove (174) for the trigger (36) there is a cutout (175) for the projection (30) of the load (12).

38. The pistol of claim 32, characterized in that along the left side wall of the through groove (174) for the trigger (36) there is disposed a guiding projection (44) which rises above the base (204) and is adjacent to the inner side of the support limiter (26) of the load (12), excluding transverse displacement of the load (12) relative to the support (5) and fixing the axle (178) of the auto-sear (46) against dropping out from the trigger (36).

39. The pistol of claim 32, characterized in that on a rear wall (291) of the rear projection (10) above the opening (8) a lug (290) is disposed.

40. The pistol of claim 1, further comprising a buffer spring (24) set onto the barrel (6) and located between the inner wall (23) of the rear space (22) of the load (12) and the front wall (25) of the upper rear projection (10) of the support (5).

41. The pistol of claim 1, characterized in that the mainspring (19) set onto the barrel (6) is installed between an inner wall (18) in a cylindrical depression (17) of the load (12) and a wall (20) of a depression (21) provided in the rear part of the upper front projection (9) of the support (5).

42. The pistol of claim 1, characterized in that on inner side walls (354) in the rear part of the breech block (2) cutouts (360) are made from below, into which projections (356) are installed, disposed on side walls (357) of the body (56) of the valve (57), when the breech block (2) is set from above onto the pistol frame 1; the cutouts (360) are connected with horizontal grooves (355) disposed along inner side walls (354), in which horizontal grooves (355) the projections (356) are disposed, when the breech block (2), moving along the pistol frame (1), occupies the rearmost position and proves to be fit tightly onto the pistol frame (1); in the front wall (208) of the breech block (2) an opening (351) is disposed for the cylinder (11) of the support (5), and under it an opening (210) for a rod (206) is disposed; in the rear wall of the breech block (2) a groove (352) for accommodating a head (67) of a hammer (55), the groove (352) being defined from the front by a strap (353) and abutting by its edge against a partition (59).

43. The pistol of claim 42, characterized in that the length of the horizontal grooves (355) is greater than the distance between a front wall (358) of the upper front projection (9) of the support (5) and an inner side (359) of the front wall (208) of the breech block (2).

44. The pistol of claim 1, further comprising a rod (206) which with its one end, having a cylindrical head (207) whose diameter is greater than the cross-section of the rod (206), is installed in a depression (205) provided in the base (204) of the support (5) under the upper front projection (9) parallel to the axis of the cylinder (11), a return spring (209) spring being located on the rod (206) between the head (207) and the inner side (359) of the front wall (208) of the breech block (2), the return spring (209) being compressed when the breech block (2) is installed on the pistol frame (1), the other end of the rod (206) being disposed in a lower opening (210) on the front wall of the breech block (2), ruling out casual jumping of the breech block (2) off the pistol frame (1).

45. The pistol of claim 1, further comprising two stops (362) and two buttons (369) with blocks (375), disposed on different sides of the base (204) of the support (5), ruling out casual jumping of the breech block (2) off the pistol frame (1).

46. The pistol of claim 45, characterized in that each stop (362) which comprises a plate with a projection (364) in its middle part is disposed in a horizontal groove (361) located under the lowering member (203) in the front part of the base (204) of the support (5) parallel to the direction of movement of the barrel (6).

47. The pistol of claim 46, characterized in that the projection (364) of the stop (362) is disposed in a deep groove (363) which limits the displacement of the stop (362) in the horizontal groove (361) under the action of a spring (366) installed in the deep grove (363) between its rear wall (365) and the projection (364).

48. The pistol of claim 46, characterized in that a part of the stop (362) is made with a longitudinal oval groove (367) to limit dropping out of the spring (366) from the deep groove (363).

49. The pistol of claim 45, characterized in that each button (369) is disposed inside the pistol frame (1), and a pilot projection (380) on an outer side (379) of the button (369) through an opening (381) in the pistol frame (1) extends above its lateral side and can move vertically along this opening (381), the button (369) with its side (370) opposite the projection (380) being able to move along a vertical groove (368) disposed on the lateral side of the base (204) of the support (5), as well as to move above a part of the horizontal groove (361), in front of the through passage (197) for the sear (39).

50. The pistol of claim 45, characterized in that each block (375) is located on a spring (378) in a depression (376) disposed in a vertical groove (368) in the side wall of the base (204) under the horizontal groove (361); when a conical head (377) of the block (375) sinks in a lower depression (373) provided on the inner side (370) of the button (369), the button (369) assumes its upper position, a depression (371) provided in the upper part on the inner side (370) of the button (369) becomes disposed above the horizontal groove (361), blocking the movement of the stop (362), whereby stable position of the breech block (2) on the pistol frame (1) is fixed; when the conical head (377) of the block (375) sinks in an upper depression (372) of the button (369), the button (369) assumes its lower position, the depression (371) becomes disposed opposite the horizontal groove (361) and releases the stop (362) for free movement.

51. The pistol of claim 1, characterized in that the striker-and-trigger mechanism comprises a trigger (36) mounted on an axle (171) which through openings (172) provided in a lower middle part of side walls (173) of a groove (174) of the support (5) is secured on the pistol frame (1); an auto-sear (46) disposed between the lowering member (203) and the trigger (36) under the barrel (6) in the support (5); a sear (39) installed in a through vertical passage (197) of the support (5); a trigger bar (33) located inside the pistol frame (1) between the pistol frame (1) and the support (5) and interconnecting the load (12) and the hammer (55) which is installed in a depression (58) provided in the rear part of the pistol frame (1) in front of a partition (59) separating the body (56) of the valve (57) from the depression (58), the hammer (55) being mounted through openings (61) in the hammer (55) on an axle of rotation (60) installed in openings (62) provided in a lug (63) and in a rounded lug (64), each of them being disposed on its respective internal partition (65) and (66) which rule out transverse displacement of the hammer (55); a finger (183) and a limiter (184) disposed in a depression (211) in the rear part of the support (5) opposite each other on different sides of the trigger (36), opposite a large opening (213) and a small opening (214) respectively, disposed in a rear wall (212) of the support (5).

52. The pistol of claim 51, characterized in that the hammer (55) has a head (67) for the shooter's thumb, a lateral shoulder (69) with a pivot (54) at the end thereof, the lateral shoulder being located inside a groove (70) defined by the internal partition (66) and by the side wall of the pistol frame (1); a lower projection (71) for interacting with a safety lock (73), a groove (68) disposed below between the lateral shoulder (69) and the lower projection (71) for accommodating the rounded lug (64).

53. The pistol of claim 51, characterized in that the trigger bar (33) through an opening (53) is set with its one end onto the pivot (54) of the hammer (55) and through an opening (32) it is set with its other end onto the pivot (31) of the load (12), insuring the backward travel of the load (12) with the barrel (6) when the hammer (55) is cocked or ruling out the travel of the load (12) with the barrel (6) when the hammer (55) is blocked by the safety lock (73).

54. The pistol of claim 51, characterized in that the trigger (36) has a triggering arm (176) in the lower part thereof and two smaller arms (35) in the form of a fork in the upper part thereof, the smaller arms (35) terminating with a radius part (41) interacting with an inclined wall (40) of the groove (34) of the load (12); a decoupling projection (179) in front for interacting with the sear (39), and a larger L-shaped arm (180) in the rear, which interacts with the finger (183) and with the limiter (184).

55. The pistol of claim 54, characterized in that at the end of the larger arm (180) in an opening (181) an axle of rotation (182) is located, on which lower parts of the finger (183) and of the limiter (184) are mounted.

56. The pistol of claim 51, characterized in that the auto-sear (46) has a short arm (188) which is disposed between the smaller arms (35) of the trigger (36) on an axle (178) secured in the smaller arms (35) and smoothly passes into a longer arm (190) which terminates with a bevel (192) which interacts with a lowering member (203) and is disposed at an angle to a bearing side (193) of a bolt camming lug (191) which interacts with a pin (195) of the load (12) and is disposed from above of the longer arm (190), the auto-sear (46) having a horizontal bearing platform (194) between the bevel (192) and the bearing side (193).

57. The pistol of claim 56, characterized in that the end part of the short arm (188) of the auto-sear (46) is connected by a pressing spring (186) to the upper part of the larger arm (180) of the trigger (36).

58. The pistol of claim 51, characterized in that the sear (39) is a rectangular parallelepiped having a depression (48) below, in which a spring (49) is disposed, which abuts against the trigger bow (50) inside the pistol frame (1); in the lower part on the side facing the trigger (36) a projection (51) is provided, whose end part through a lower slit (199) in a separating partition (198) which defines a through passage (197) in the support (5), is located in a groove (174) for the trigger (36); the projection (51) adjoins with its upper inclined edge (52) the decoupling projection (179) of the trigger (36), the guide of the projection (51) coinciding with the guide of the groove (47) which is located in the upper part of the sear (39) between two shoulders (38) and in which a part of the longer arm (190) of the auto-sear (46) is disposed.

59. The pistol of claim 58, characterized in that with the trigger (36) in normal position, when its cocking arm (176) is not pressed by the shooter's finger and the inclined edge (52) of the projection (51) does not adjoin the decoupling projection (179), the sear (39) under the action of the spring (49) is found in the uppermost position, presses on the load (12) from below, the bearing platform (194) of the auto-sear (46) abuts against the pin (195) of the load (12) and blocks the movement of the barrel (6) with the load (12), thus ruling out the possibility of a casual shot.

60. The pistol of claim 58, characterized in that the sear (39) can move down along the through passage (197) in the support (5) under the pressure exerted by the decoupling projection (179) of the trigger (36) on the projection (51) of the sear (39), when the cocking arm (176) of the trigger (36) is pressed by the shooter's finger, the auto-sear (46) under the action of the smaller arms (35) of the trigger (36) moving forward along the groove (200) in the support (5), the mainspring (19) becomes compressed, and the buffer spring (24) becomes extended, since the barrel (6) moves forward under the pressure exerted by the bearing side (193) of the auto-sear (46) on the pin (195) of the load (12) till the bearing side (193) of the bolt camming lug (191) gets loose from the pin (195) of the load (12), whereafter a shot takes place, the sear (39) assumes the lowermost position, the auto-sear (46) is found below the pin (195) and does not interfere with the load (12) and the barrel (6) moving backward.

61. The pistol of claim 51, characterized in that the finger (183) has an inclined edge (215) adjoining a lower edge (216) of a large opening (213) in a rear wall (212) of the support (5), which hinders the turn of the finger (183) relative to the trigger (36); on a lateral side (217) of the finger (183), facing the trigger (36), there is a lateral projection (218), the lateral projection (218) lying down on an inner side (219) of the wall (212) of the support (5), when the inclined edge (215) ceases to adjoin the lower edge (216) of the opening (213) after the trigger (36) is pulled; in the middle part of the inclined edge (215) there is a step (221), next to which an opening (220) is provided to receive a bent end of the return spring; the place of junction of an upper edge (224) with the inclined edge (215) terminates with a projection (225) rounded from above and having a vertically arranged platform (226) in the front part thereof.

62. The pistol of claim 61, characterized in that the return spring of the finger (183) is secured with its other bent end on a pin (236) installed in side walls (238) in openings (237) in the rear part of the support (5).

63. The pistol of claim 61, characterized in that the finger (183) is able to turn relative to the trigger (36), when, as the trigger (36) is pulled, the bearing side (193) of the bolt camming lug (191) of the auto-sear (46) ceases to adjoin the pin (195) of the load (12) under the action of the lowering member (203) on the bevel (192) of the auto-sear (46); the rounded projection (225) of the finger (183), abutting against the upper edge (239) of the large opening (213) in the rear wall (212) of the support (5), comes out above the surface of the rear wall (212) of the support (5) and through the large opening (272) in the front wall (99) of the magazine (27) enters a container (100) with a bullet (246) for supplying the container (100) to the shooting position.

64. The pistol of claim 51, characterized in that the limiter (184) has an inclined edge (227) adjoining the lower edge (228) of the small opening (214) in the rear wall (212) of the support (5), which hinders the turn of the limiter (184) relative to the trigger (36); on a lateral side (229) of the limiter (184), facing the trigger (36), there is a lateral projection (230), the lateral projection (230) lying down on an inner side (219) of the rear wall (212) of the support (5), when the inclined edge (227) ceases to adjoin the lower edge (228) of the small opening (214) after the trigger (36) is pulled; in the middle part near the inclined edge (227) an opening (232) is provided to receive a bent end of the return spring (233); the place of junction of an upper edge (234) with the inclined edge (227) terminates with a projection (235) rounded from above.

65. The pistol of claim 64, characterized in that the return spring (233) of the limiter (184) is secured with its other bent end on the same pin (236) as the return spring of the finger (183).

66. The pistol of claim 64, characterized in that the limiter (184) is able to turn with respect to the trigger (36) through the same angle as the finger (183), when, as the trigger (36) is pulled, the bearing side (193) of the bolt camming lug (191) of the auto-sear (46) ceases to adjoin the pin (195) of the load (12) under the action of the lowering member (203) on the bevel (192) of the auto-sear (46), the rounded projection (235) of the limiter (184), abutting against the upper edge (240) of the small opening (214) in the rear wall (212) of the support (5), comes out above the surface of the rear wall (212) of the support (5) and through the small opening (273) in the front wall (99) of the magazine (27) enters an empty container (100) for removing it from the shooting position after the shot.

67. The pistol of claim 1, further comprising a safety lock (73), a lock (91) and a detent (85) for blocking the hammer (55) to rule out a casual shot.

68. The pistol of claim 67, characterized in that the safety lock (73) has a thumb piece (78) with a ledge (79), which adjoins from the outside the surface of the pistol frame (1), a cylinder (72) with a flat (74), disposed perpendicular to the surface of the thumb piece (78), a projection (80) disposed between the ledge (79) and the cylinder (72) and having a groove (90) made on the side opposite the place where an upper depression (82) and a lower depression (83) are located, perpendicular to the axis of symmetry of the cylinder (72), and a pivot (76) disposed on an end face side (75) of the cylinder (72), the projection (80) and the cylinder (72) being located in an opening (81) in the pistol frame (1).

69. The pistol of claim 68, characterized in that the pivot (76) is located in an opening (77) disposed under a rounded lug (64) in a partition (66) separating a depression (58) adapted to receive the hammer (55) from a groove (70) in which a lateral shoulder (69) of the hammer (55) is located.

70. The pistol of claim 68, characterized in that on the ledge (79) opposite a detent (85) two depressions are provided, a head (86) of the detent (85) being disposed in an upper depression (82), when the thumb piece (78) is in the uppermost position, and the flat (74) of the cylinder (72) assumes a horizontal position and releases the projection (71) of the hammer (55) for it to be cocked or is disposed in the lower depression (83), when the thumb piece (78) is in the lowermost position and the flat (74) assumes an inclined position and blocks the hammer (55), ruling out a shot.

71. The pistol of claim 67, characterized in that the lock (91) has an L-shaped projection (92) in whose upper part there is an opening (93) through which the lock (91) is mounted on an axle of rotation (60) of the hammer (55), a lower part of the lock (91) is disposed in a groove (94) which is found between the partition (65) that separates the depression (58) adapted to receive the hammer (55) and the wall of the pistol frame (1), a leg (95) of the L-shaped projection (92) being inserted into the groove (90) of the projection (80) of the safety lock (73) and fixing the position of the safety lock (73) in the pistol frame (1).

72. The pistol of claim 67, characterized in that the detent (85) is installed in an opening (84) of the pistol frame (1), and its conical head (86) under the pressure of a spring (87) located in an opening (84) between a side wall (357) of the body (56) of the valve (57) and the detent (85) sinks in one of depressions (82 or 83) on the ledge (79) of the safety lock (73), fixing the position of the safety lock (73) relative to the hammer (55).

73. The pistol of claim 1, further comprising a latch (332) and a lock (318) for retaining the magazine (27) in the grip (3).

74. The pistol of claim 73, characterized in that the latch (332) has two flat cheeks (333), each of the cheeks (333) having a configured front projection (335), a lower projection (338) and a cross member (334) which interconnects the upper parts of the cheeks (333) and has a cutout (342) from below for a spring (343); through openings (344) in the cheeks (333) the latch (332) is mounted on an axle (331) disposed in an opening (328) in a narrowing (329) of the trigger bow (50), the configured projections (335) of the cheeks (333) through openings (337) in the body of the grip (3), disposed symmetrically relative to the trigger bow (50), are found on different sides of the narrowing (329) of the trigger bow (50).

75. The pistol of claim 74, characterized in that between the cross member (334) of the latch (332) and the inner wall of the body of the grip (3) a spring (343) is installed.

76. The pistol of claim 73, characterized in that the lock (318) which is located between the cheeks (333) of the latch (332) and adjoins the cross member (334) from the side opposite the front configured projections (335) of the latch (332) is made as a lever, whose lower part is made as an unlocking fork (322) having two arms (323) which through openings (326) provided therein are mounted on an axle (327) installed in an opening (328) of a lug (324) disposed between the arms (323) of the lock (318) on a projection (321) posed inside the body of the grip (3) on the trigger bow (50); on the end of each arm (323) from the outside there is a projection (325), arranged perpendicular to the lateral edge of the arm (323) of the lock (318) and adjoining a rear inclined edge (341) of a lower projection (338) of the lock (318); in the middle of the lock (318), on the side facing the latch (332), a depression (319) is provided to receive a spring (320) of the lock (318); in the upper part of the lock (318) from the side of the magazine (27) a head (317) is disposed, which sinks in -a depression (316) on the front wall (99) of the magazine (27), fixing the position of the magazine (27) in the grip (3), when the front configured projections (335) of the latch (332) occupy the uppermost position and the cross member (334) exerts pressure on the upper part of the lock (318) or leaves the depression (316) in the front wall (99) of the magazine (27), releasing the magazine (27) to move in the grip (3), when the front configured projections (335) of the latch (332) under the action of the shooter's finger take the lowermost position and the rear inclined edges (341) of the projections (338) of the latch (332) exert pressure on the projections (325) of the lock (318).

77. The pistol of claim 76, characterized in that in the depression (319) of the lock (318) a spring (320) is disposed, which abuts with its other end against a projection (321) on the trigger bow (50).

78. The pistol of claim 1, further comprising a rocker arm (295) and a slide stop (306) for retaining the breech block (2) on the pistol frame (1).

79. The pistol of claim 78, characterized in that the slide stop (306) through an opening (309) disposed in the lower part thereof is mounted on an axle (171) of the trigger (36) inside the pistol frame (1) and has in front an inflexion (310) disposed in a cutout (311) on the end face of the side wall of the pistol frame (1), with a bent away button (308) disposed from the external lateral side of the pistol frame (1); under the inflexion (310) an opening (305) is provided for accommodating a carrier (301) of the rocker arm (295); from below in the middle of the slide stop (306) there is a projection (313), onto which a spring is set, whose other end is installed in a depression (315) disposed inside the pistol frame (1) so that it presses the slide stop (306) to the breech block (2).

80. The pistol of claim 78, characterized in that the rocker arm (295) has a short shoulder (300), wherein there is an opening (302) through which the rocker arm (295) is mounted on an axle in a groove (304) of the pistol frame (1), and a long shoulder (297), whose end part (296) is disposed in a groove (298) in the pistol frame (1), and a bend (294) disposed in the middle part thereof adjoins a step (293) on the side wall (292) of the magazine (27); on the end of the short shoulder (300) of the rocker arm (295) there is a carrier (301) bent away in the same direction as the bend (294), the carrier (301) entering an opening (305) in the slide stop (306), the rocker arm (295) being able to rotate on an axle within the opening (305) till it abuts against the lower wall of the groove (298).

* * * * *